US009046110B2

(12) United States Patent
Teraoka et al.

(10) Patent No.: US 9,046,110 B2
(45) Date of Patent: Jun. 2, 2015

(54) CROSSFLOW FAN AND AIR CONDITIONER PROVIDED WITH SAME

(75) Inventors: Hironobu Teraoka, Sakai (JP); Shimei Tei, Sakai (JP); Toru Iwata, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 793 days.

(21) Appl. No.: 13/255,196

(22) PCT Filed: Mar. 9, 2010

(86) PCT No.: PCT/JP2010/053915

§ 371 (c)(1), (2), (4) Date: Sep. 7, 2011

(87) PCT Pub. No.: WO2010/104083

PCT Pub. Date: Sep. 16, 2010

(65) Prior Publication Data

US 2011/0318189 A1 Dec. 29, 2011

(30) Foreign Application Priority Data

Mar. 10, 2009 (JP) ..... 2009-056970

(51) Int. Cl.

| | |
|---|---|
| ***F01D 5/14*** | (2006.01) |
| ***F04D 29/28*** | (2006.01) |
| ***F04D 17/04*** | (2006.01) |
| ***F04D 29/30*** | (2006.01) |
| ***F24F 1/00*** | (2011.01) |

(52) U.S. Cl.

CPC ..... *F04D 29/283* (2013.01); *F04D 17/04* (2013.01); *F04D 29/30* (2013.01); *F24F 1/0025* (2013.01); *F24F 2001/0048* (2013.01)

(58) Field of Classification Search

CPC ..... F04D 17/04; F04D 29/30; F04D 29/66; F04D 29/283

USPC ..... 416/223 R, 236 R

See application file for complete search history.

(56) References Cited

U.S. PATENT DOCUMENTS

| | | | | |
|---|---|---|---|---|
| 6,126,395 | A * | 10/2000 | Shingai | 415/200 |
| 8,007,240 | B2 * | 8/2011 | Sanagi et al. | 416/186 R |
| 2009/0028719 | A1 * | 1/2009 | Teraoka et al. | 416/223 R |
| 2014/0044552 | A1 * | 2/2014 | Smyth et al. | 416/228 |

FOREIGN PATENT DOCUMENTS

| | | | |
|---|---|---|---|
| JP | 3-210094 | A | 9/1991 |
| JP | 5-332294 | A | 12/1993 |
| JP | 8-240197 | A | 9/1996 |
| JP | 2006-125390 | A | 5/2006 |
| JP | 2007-10259 | A | 1/2007 |
| JP | 2007-292053 | A | 11/2007 |
| JP | 2008-223760 | A | 9/2008 |

* cited by examiner

*Primary Examiner* — Nathaniel Wiehe
*Assistant Examiner* — Woody A Lee, Jr.
(74) *Attorney, Agent, or Firm* — Birch, Stewart, Kolasch & Birch, LLP

(57) ABSTRACT

A crossflow fan includes a rotary impeller formed by curved blades 42. Each of the blades 42 has an outer peripheral edge 43 close to the centrifugal side of the impeller and an inner peripheral edge 44 close to the rotation axis side of the impeller. A plurality of cutouts 45 are formed in the outer peripheral edge 43 and spaced apart at predetermined intervals. Dimples 48 for changing a boundary layer from a laminar flow to a turbulent flow are formed in a negative pressure surface 4*q* of each blade 42 in the vicinity of the outer peripheral edge 43 to prevent the gas flowing around the blade 42 from separating from the blade 42.

3 Claims, 19 Drawing Sheets

CROSSFLOW FAN AND AIR CONDITIONER PROVIDED WITH SAME

TECHNICAL FIELD

The present invention relates to a crossflow fan and an air conditioner having such a crossflow fan.

BACKGROUND ART

Typically, a wall-mounted air conditioner includes a crossflow fan as an air blower. As shown in FIG. 24, a crossflow fan 104 is a transverse flow air blower (a through flow air blower). The crossflow fan 104 causes the air to flow through an impeller 141 in such a manner as to cross a plane perpendicular to the rotation axis Z of the impeller 141. The impeller 141 is formed by a plurality of blades (flaps) 142. The impeller 141 rotates in the direction indicated by arrow Z1 in FIG. 24. As a result, after having been cooled or heated by the air conditioner, the air passes through the impeller 141 and is then blown out into the room in which the air conditioner is mounted. Patent Document 1 discloses a blade having a plurality of cutouts that are formed in the outer periphery of the blade and spaced apart at predetermined intervals to reduce noise produced by a fan.

Specifically, with reference to FIGS. 25 and 26, blades 242, which configure an impeller 241, each include an outer peripheral edge 243 and an inner peripheral edge 244. The outer peripheral edges 243 are arranged at the centrifugal side of the impeller 241 and the inner peripheral edges 244 are located at the rotation axis side of the impeller 241. Each of the outer peripheral edges 243 has a plurality of cutouts 245, which are spaced apart at predetermined intervals. As a result, each of the blades 242 has cut portions 246, which are cut in the outer peripheral edge 243, and basic shape portions 247, each of which is formed between the corresponding adjacent pair of the cut portions 246 as a non-cut portion in the outer peripheral edge 243.

Recently, it has been desired to save energy consumed by crossflow fans. However, although noise is reduced by a simple configuration such as cutouts formed in blades like those in the blades of Patent Document 1, the power produced by an electric motor that is necessary for rotating an impeller, which is the drive power for a crossflow fan, cannot be reduced sufficiently.

PRIOR ART REFERENCE

Patent Document

Patent Document 1: Japanese Laid-Open Patent Document No. 2006-125390

SUMMARY OF THE INVENTION

The Problem That the Invention To Solve

Accordingly, it is an objective of the present invention to provide a crossflow fan that reduces drive power effectively and an air conditioner having such a crossflow fan.

Means For Solving the Problem

To achieve the foregoing objective and in accordance with a first aspect of the present invention, a crossflow fan comprising a rotary impeller formed by curved blades is provided. Each blade has an outer peripheral edge arranged at a centrifugal side of the impeller and an inner peripheral edge located at a rotation axis side of the impeller. A plurality of cutouts are formed in at least one of the outer peripheral edge and the inner peripheral edge and spaced apart at predetermined intervals. A turbulent boundary layer controlling structure that prevents a gas flowing around the blade from separating from the blade by changing a boundary layer from a laminar flow to a turbulent flow is formed in a negative pressure surface of the blade at the peripheral edge in which the cutouts are formed.

In this configuration, cutouts are formed in at least one of the outer peripheral edge and the inner peripheral edge, and spaced apart at predetermined intervals. Noise is thus reduced through a simple configuration. The turbulent boundary layer controlling structure (which is, for example, dimples, grooves, or rough surfaces), which changes a boundary layer from a laminar flow to a turbulent flow, is formed in the negative pressure surface of the peripheral edge, in which the cutouts are formed to prevent the gas flowing around the blade from separating from the blade. The boundary layer on the negative pressure surface of the blade is thus changed from a laminar flow to a turbulent flow. Particularly, according to the present invention, the multiple cutouts are formed in the peripheral edge of the blade and spaced apart at the predetermined intervals. This allows gas flowing around the blade to enter the cutouts easily, thus breaking two dimensionality of the flow of gas on the negative pressure surface of the blade. As a result, the turbulent boundary layer controlling structure, which is dimples or irregular rough surfaces, prevents the gas flow with the broken two dimensionality (a three-dimensional flow) from separating from the blade. This decreases the resistance of the pressure acting on the blade and effectively reduces the drive power for the crossflow fan, compared to a case in which no turbulent boundary layer controlling structure is provided.

In the crossflow fan described above, the turbulent boundary layer controlling structure is preferably a dimple.

In this configuration, the turbulent boundary layer controlling structure for changing a boundary layer from a laminar flow to a turbulent flow is dimples. This prevents separation of the gas flowing around the blade with improved effectiveness, compared to a case in which a groove extending in the flow direction of the gas is the turbulent boundary layer controlling structure. Specifically, by changing the boundary layer from a laminar flow to a turbulent flow and generating a secondary flow in the dimples, the shearing force produced at the bottom of the boundary layer is decreased. As a result, the gas flowing around the blade is effectively prevented from separating from the blade.

In the above described crossflow fan, the dimple is preferably one of a plurality of dimples. The dimples are formed along a flow direction of the gas and in the negative pressure surface of the blade in the vicinity of the peripheral edge in which the cutouts are formed. A first dimple of the dimples that is spaced from the peripheral edge in which the dimples are formed has a small depth compared to the depth of a second dimple that is closer to the peripheral edge in which the dimples are formed than the first dimple.

In this configuration, loss caused by the secondary flow of gas is decreased in the dimples at the downstream side, which have a small effect in suppressing development of a boundary layer. Accordingly, compared to a case in which the dimples have equal depths, the drive power for the crossflow fan is effectively reduced.

In the above described crossflow fan, the dimple is preferably one of a plurality of dimples. The dimples are formed along a flow direction of the gas and in the negative pressure surface of the blade in the vicinity of the peripheral edge in which the cutouts are formed. The dimples have depths that become smaller from the peripheral edge in which the dimples are formed toward the other peripheral edge.

In this configuration, the loss caused by the secondary flow of gas is decreased in the dimples, which have a small effect in suppressing development of a boundary layer. Accordingly, compared to a case in which the dimples have equal depths, the drive power for the crossflow fan is effectively reduced. The dimples the depths of which become smaller from the corresponding peripheral edge toward the other peripheral edge may be some or all of the dimples that are located closer to the corresponding peripheral edge.

In the above described crossflow fan, each blade preferably has a cut portion that is cut in at least one of the outer peripheral edge and the inner peripheral edge and a basic shape portion that is a non-cut portion. The blade thickness at the cut portion is small compared to the blade thickness at the basic shape portion adjacent to the cut portion.

In this configuration, the blade thickness at the cut portion is small compared to the blade thickness at the basic shape portion adjacent to the cut portion. The surface area of the end surface of the cut portion is thus reduced compared to a case in which the blade thickness at the cut portion and the blade thickness at the basic shape portion are equal. This decreases the collision loss generated when gas flows into the blade. As a result, the drive power for the crossflow fan is reduced with increased effectiveness.

In the above described crossflow fan, each blade preferably has a cut portion that is cut in at least one of the outer peripheral edge and the inner peripheral edge, and a basic shape portion that is a non-cut portion. The turbulent boundary layer controlling structure is formed in the basic shape portion.

In this configuration, if the blade is formed in such a manner that the blade thickness at the cut portion becomes small compared to the blade thickness at the basic shape portion adjacent to the cut portion, a turbulent boundary layer controlling structure, which is a dimple or groove having a desired depth, is formed easily. In other words, the depth of the dimple, which is the turbulent boundary layer controlling structure, is ensured easily.

To achieve the foregoing objective and in accordance with a second aspect of the present invention, an air conditioner is provided that has the above described crossflow fan.

In this configuration, the air conditioner includes the above-described crossflow fan. This reduces noise through a simple configuration and effectively reduces the drive power for the crossflow fan.

EMBODIMENTS FOR CARRYING OUT THE INVENTION

Figure 1:
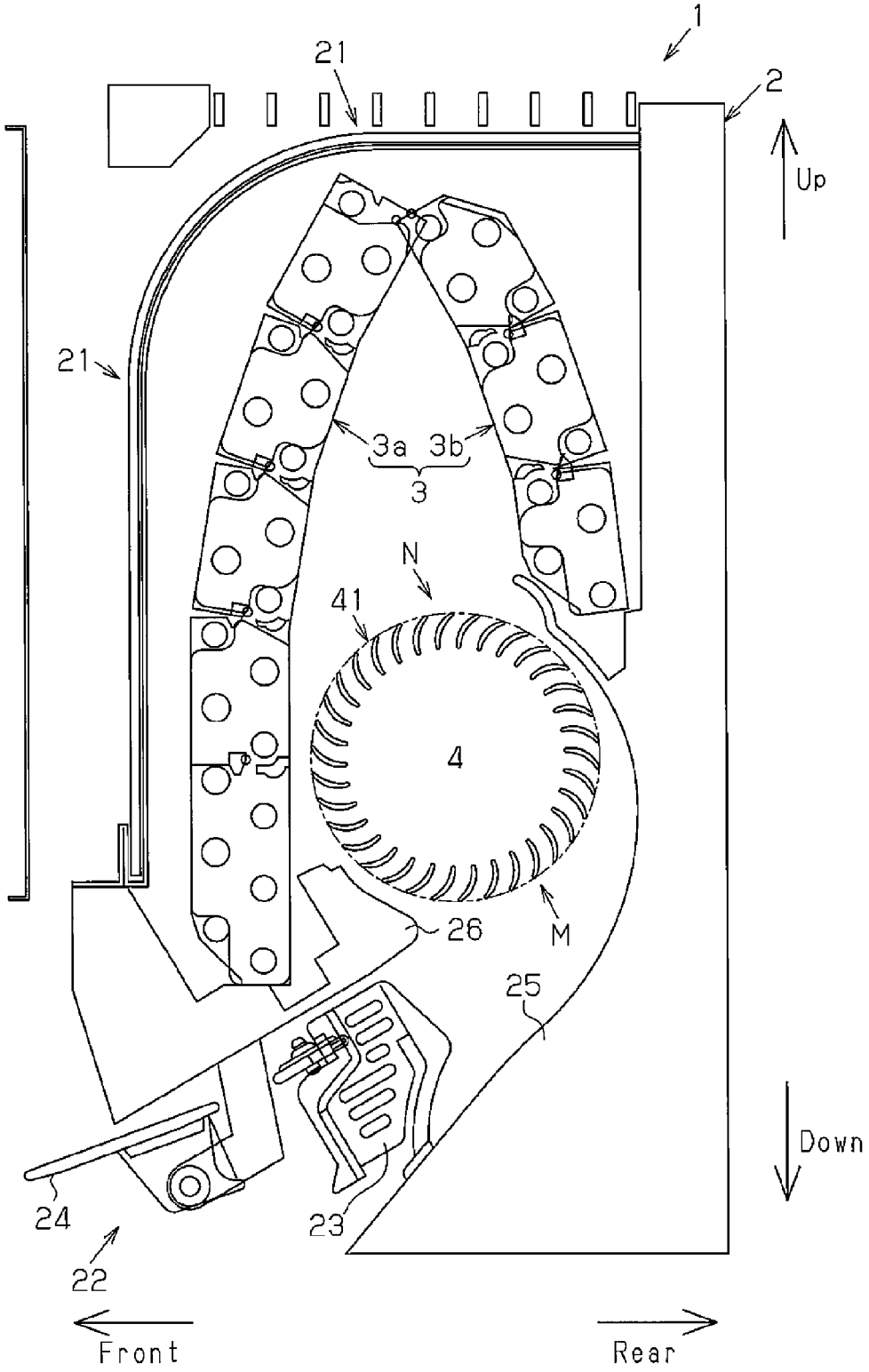
FIG. 1 is a cross-sectional view schematically showing the configuration of an air conditioner having a crossflow fan according to one embodiment of the present invention.

Embodiments of the present invention will now be described with reference to the attached drawings. Arrow A in the drawings indicates a direction parallel to the rotation axis of an impeller. Arrow S in the drawings indicates the centrifugal side, which is spaced further from the rotation axis of the impeller in a direction perpendicular to the axial direction. Arrow U in the drawings indicates the rotation axis side, which is close to the rotation axis of the impeller in the direction perpendicular to the axial direction.

(First Embodiment)

As shown in FIG. 1, an air conditioner 1 is a wall-mounted indoor unit. The air conditioner 1 is formed by a casing 2, which is a housing, a heat exchanger 3 arranged in the casing 2, and a crossflow fan 4 arranged downstream from the heat exchanger 3.

Air inlets 21 for drawing air into the casing 2 are formed in a top surface and a front surface of the casing 2. An air outlet 22 for blowing air out to the casing 2 is formed between the front surface and a bottom surface of the casing 2. A vertical flap 23 and a horizontal flap 24 are arranged in the air outlet 22. The vertical flap 23 and the horizontal flap 24 are used to adjust the direction of the air blown out of the air outlet 22.

A guide portion 25 and a backflow preventing tongue 26 are arranged in the casing 2. The guide portion 25 guides the air sent by a crossflow fan 4 in a forward direction. The backflow preventing tongue 26 prevents the air sent by the crossflow fan 4 from flowing backward. The guide portion 25 and the backflow preventing tongue 26 are formed integrally with the casing 2.

The heat exchanger 3 includes a front heat exchanging portion 3*a* and a rear heat exchanging portion 3*b*. The front heat exchanging portion 3*a* is arranged in a zone in the casing 2 and extends from front to upper sides with respect to the crossflow fan 4. The rear heat exchanging portion 3*b* is located in a zone in the casing 2 and extends from rear to upper sides with respect to the crossflow fan 4. After having been introduced through the air inlets 21, the air passes through the heat exchanger 3 and is thus cooled or heated to produce conditioned air. The conditioned air is then discharged into the room by the crossflow fan 4 through the air outlet 22.

The crossflow fan 4 is configured by an impeller 41 having blades (flaps) 42, the casing 2 forming a passage for the air sent by the crossflow fan 4, and an electric motor for driving the impeller 41 (the crossflow fan 4). When power is supplied to the electric motor, the electric motor drives the crossflow fan 4.

Figure 2:
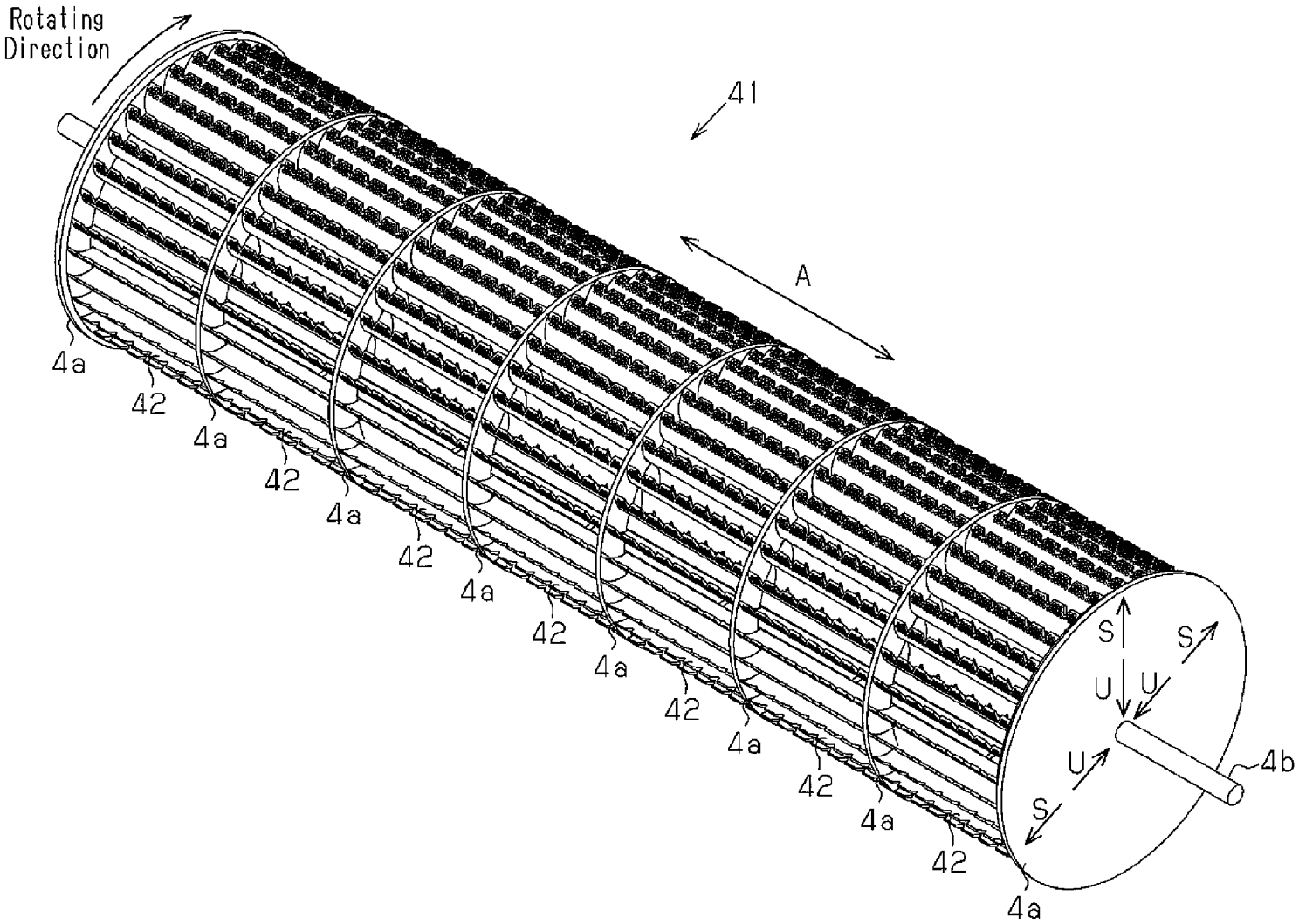
FIG. 2 is a perspective view showing the crossflow fan of the illustrated embodiment.
Figure 3:
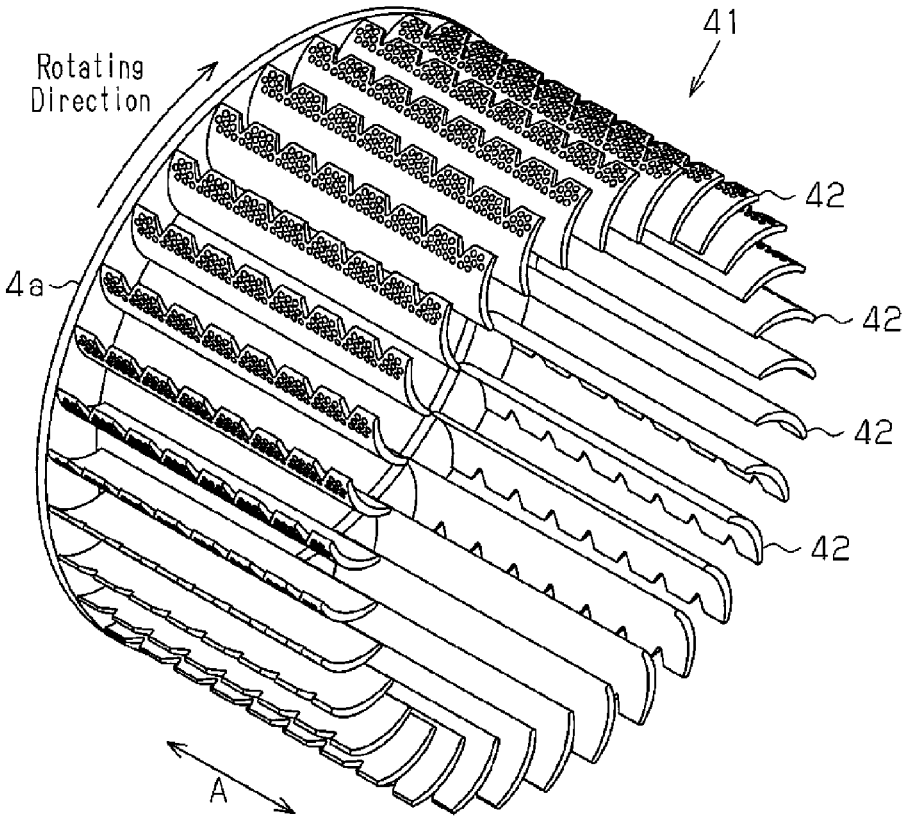
FIG. 3 is a perspective view showing an impeller according to a first embodiment of the present invention.

With reference to FIGS. 2 and 3, the impeller 41 of the crossflow fan 4 is configured by a plurality of blades 42, support plates 4*a* supporting the corresponding blades 42, and a rotary shaft 4*b*. The support plates 4*a* are connected to the ends of the blades 42 in the axial direction A. The rotary shaft 4*b* is connected to the support plates 4*a* and the output shaft of the electric motor. The blades 42 are formed at the ends of the corresponding support plates 4*a* at the centrifugal side. The blades 42 are aligned along the direction of rotation of the impeller 41. The axes of the support plates 4*a* correspond to the axial direction A and the support plates 4*a* are arranged parallel to one another. Each of the blades 42 is arranged between the corresponding adjacent pair of the support plates 4*a* in such a manner that the ends of the blades 42 are aligned in the axial direction A. As shown in FIG. 2, each of the support plates 4*a* connected directly to the rotary shaft 4*b* is formed flat. Each support plate 4*a*, which is formed between the corresponding adjacent pair of the blades 42 in the axial direction A, has an annular shape. Each support plate 4*a* and the associated blades 42 are formed of resin and formed in a mold through injection molding as shown in FIG. 3.

With reference to FIGS. 4 to 8, each blade 42 is curved in an arcuate shape. The blade 42 has a positive pressure surface (a pressure surface) 4*p* and a negative pressure surface 4*q*. The positive pressure surface 4*p* faces in the rotating direction in such a manner as to receive relatively great pressure when the impeller 41 is rotated from a stationary state. The negative pressure surface 4*q* faces in the opposite direction to the rotating direction in such a manner as to receive relatively small pressure when the impeller 41 is rotated from the stationary state. Each blade 42 has an outer peripheral edge 43 arranged at the centrifugal side of the impeller 41 and an inner peripheral edge 44 located at the rotation axis side of the impeller 41. The outer peripheral edge 43 of the blade 42 is curved in the rotating direction of the impeller 41.

A plurality of cutouts 45 are formed in the outer peripheral edge 43 and spaced apart at predetermined intervals. Each blade 42 has cut portions 46, which are cut in the outer peripheral edge 43, and basic shape portions 47, which are non-cut portions in the outer peripheral edge 43. The cut portions 46 and the basic shape portions 47 are arranged alternately in the axial direction A. The intervals by which the cutouts 45 are spaced apart may be either uniform or varied depending on the positions of the cutouts 45 in the blade 42. For example, the intervals between the cutouts 45 at either end of the blade 42 may be greater than the intervals of the cutouts 45 at the center of the blade 42. This configuration reduces noise and ensures a pressure surface area by which each blade 42 receives pressure from the air.

Figure 4:
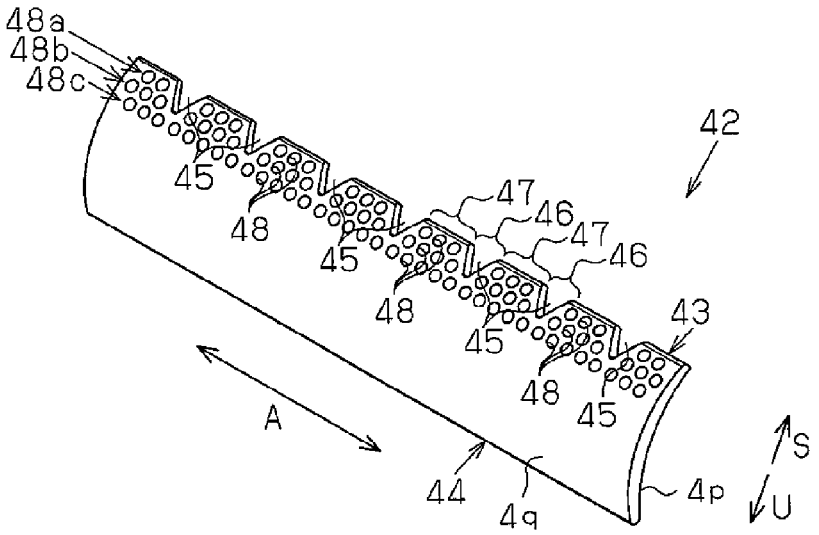
FIG. 4 is a perspective view showing a blade (a flap) of the first embodiment.
Figure 5:
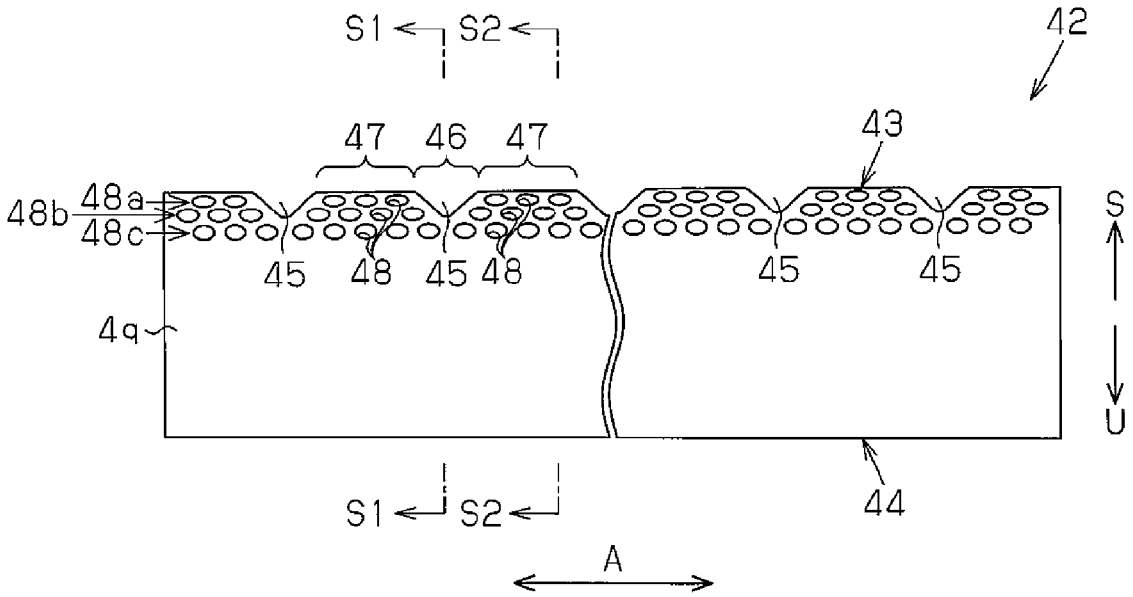
FIG. 5 is a view showing a negative pressure surface of the blade of the first embodiment.
Figure 6:
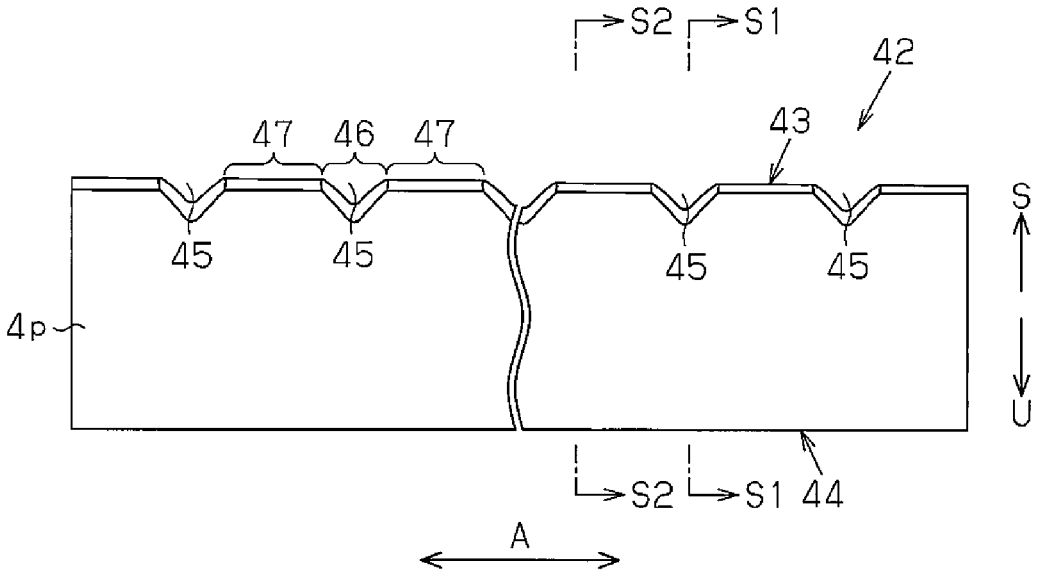
FIG. 6 is a view showing a positive pressure surface of the blade of the first embodiment.
Figure 7:
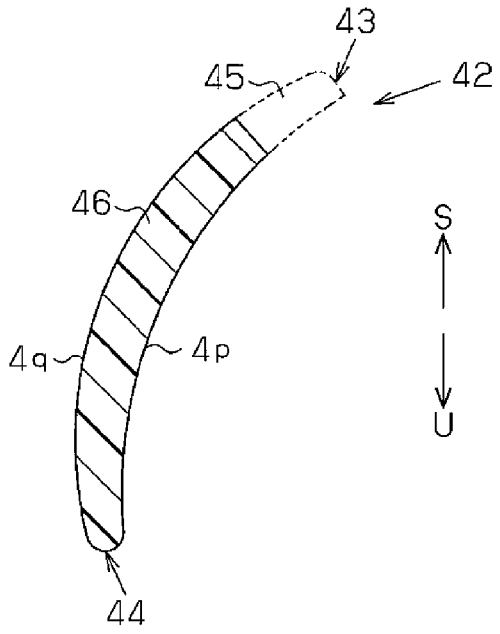
FIG. 7 is a cross-sectional view taken along line S1-S1 of FIGS. 5 and 6.

As shown in FIG. 4, for example, each of the cutouts 45 has a triangular shape but may have a rectangular shape. The sizes of the cutouts 45 may be either equal or varied depending on the positions in the axial direction A. For example, the cutouts 45 at either end of the blade 42 may be smaller in size than the cutouts 45 at the center of the blade 42. This configuration ensures a pressure surface area by which the blade 42 receives pressure from the air.

As has been described, the crossflow fan 4 has the rotary impeller 41, which is formed by the curved blades 42. The cutouts 45 are formed in the outer peripheral edge 43 of each blade 42 and spaced apart at the predetermined intervals. This configuration reduces the trailing vortex produced in an air outlet portion M (see FIG. 1) of the crossflow fan 4. Also, noise is reduced by the configuration, which is simpler than a configuration in which the outer peripheral edge 43 has a sawtooth shape.

The first embodiment is characterized by the cutouts 45, which are formed in the outer peripheral edge 43 of each blade 42 and spaced apart at the predetermined intervals, and a turbulent boundary layer controlling structure formed in the negative pressure surface 4*q* at the side corresponding to the outer peripheral edge 43. The turbulent boundary layer controlling structure prevents the air flowing around the blades 42 from becoming separated from the blades 42. The turbulent boundary layer controlling structure is a structure (dimple, grooves, or rough surfaces) that changes a boundary layer on the negative pressure surface 4*q* of each blade 42 from a laminar flow to a turbulent flow. The turbulent boundary layer controlling structure decreases the resistance to the pressure acting on the blade 42. As a result, even in a case without the turbulent boundary layer controlling structure, the drive power for the crossflow fan 4 is reduced.

Figure 8:
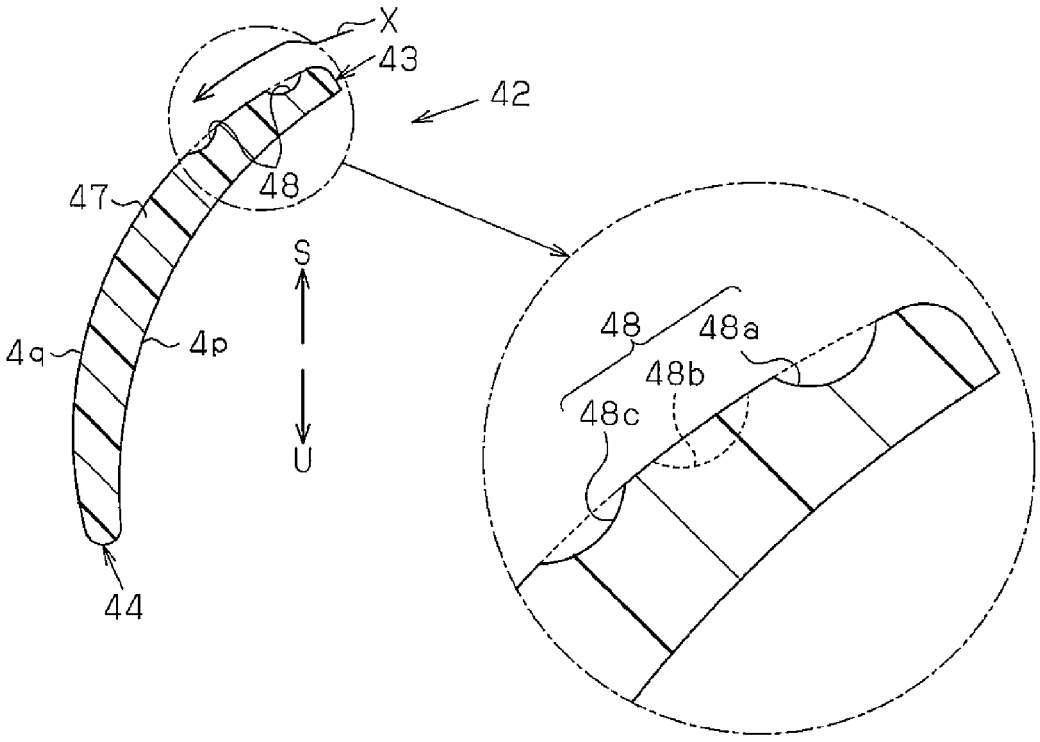
FIG. 8 is a cross-sectional view taken along line S2-S2 of FIGS. 5 and 6.

A plurality of dimples 48 are formed in the negative pressure surface 4*q* of each blade 42 at the side corresponding to the outer peripheral edge 43 as the turbulent boundary layer controlling structure. Referring to FIG. 8, for example, the dimples 48 are small recesses each having a predetermined depth and a concave surface. The dimples 48 are formed along the direction in which the air flows on the negative pressure surface 4*q* of the blade 42 (as indicated by arrow X in FIG. 8), which is the direction in which the air flows from the outer peripheral edge 43 to the blade 42 (hereinafter, referred to as "the flow-in direction X"). The direction in which the air flows on the negative pressure 4*q* of the blade 42 is substantially perpendicular to the axial direction A. More specifically, with reference to FIG. 5, for example, three rows of dimples 48*a*, 48*b*, 48*c* are formed in the negative pressure surface 4*q* of the blade 42. Each row of the dimples 48*a*, 48*b*, 48*c* is aligned along the axial direction A (which is the longitudinal direction of the blade 42). The dimples 48*a* are arranged most close to the outer peripheral edge 43 among the dimples 48*a*, 48*b*, 48*c*. The dimples 48*c* are arranged downstream from the dimples 48*a* in the flow-in direction X. In other words, the dimples 48 include the dimples 48*a* arranged at the centrifugal side and the dimples 48*c* located at the rotation axis side. The dimples 48*b* are located between the row of the dimples 48*a* and the row of the dimples 48*c*. The dimples 48*b* are arranged offset from the dimples 48*a* and 48*c* by a half pitch in the axial direction A. In this manner, one of the dimples 48*b* is arranged between each adjacent pair of the dimples 48*c*.

As illustrated in FIG. 8, the dimples 48*c* (the first dimples), which are most spaced from the outer peripheral edge 43 of each blade 42, have a small depth compared to the dimples 48*a*, 48*b* (the second dimples), which are closer to the outer peripheral edge 43 than the dimples 48*c*. In other words, the depths of the dimples 48 become smaller from the outer peripheral edge 43 toward the inner peripheral edge 44 in the blade 42. The diameters of the dimples 48*a*, 48*b*, 48*c* are equal. The term "the depth of a dimple" means the maximum depth of a dimple.

In the above-described case, some of the dimples 48 may have equal depths. In other words, the dimples 48 the depths of which become smaller from the outer peripheral edge 43 toward the inner peripheral edge 44 may be some of the dimples 48 that are located close to the outer peripheral edge 43. In the first embodiment, each of the dimples 48*a* has a depth that is equal to the depth of each of the dimples 48*b*. The depth of each of the dimples 48*c*, which are most spaced from the outer peripheral edge 43, is smaller than the depth of each of the dimples 48*a*, 48*b*, which are arranged close to the outer peripheral edge 43 compared to the dimples 48*c*.

As has been described, the depth of each dimple 48*c*, which is located at a downstream position in the flow-in direction X, is smaller than the depth of each dimple 48*a*, 48*b*, which is arranged at an upstream position.

Figure 9:
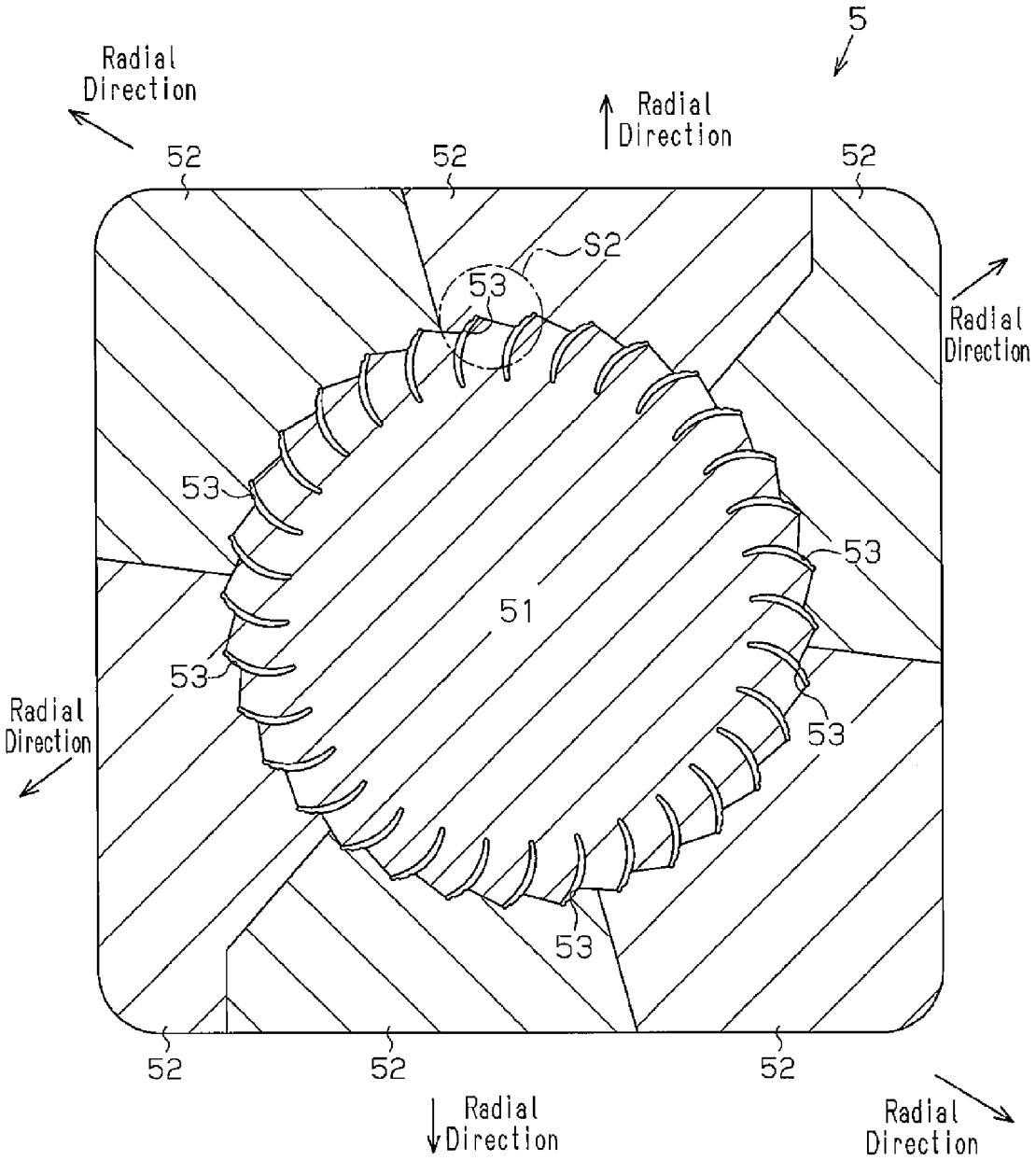
FIG. 9 is a cross-sectional view showing a mold for molding a blade of the illustrated embodiment.

Each blade 42 having the dimples 48 is formed using a mold 5, which is illustrated in FIG. 9. The mold 5 includes a mold portion 51 for shaping each positive pressure surface 4*p* and a portion of each negative pressure surface 4*q*, a plurality of mold portions 52 each for shaping the portion of each negative pressure surface 4*q* including the cutouts 45 and the dimples 48, and a mold portion 54 (see FIG. 10) for shaping the support plate 4*a*. The mold portions 52 are arranged around the mold portion 51. Projections 53 for shaping the dimples 48 project from each of the mold portions 52. Molten resin is injected into the space formed by the mold portion 51 and the mold portions 52. As the molten resin cures, the blades 42 having the dimples 48 are shaped. After the blades 42 are completed, the mold portions 52 are removed radially. The mold portions 52 are thus removed and the mold 5 is opened.

Figure 10:
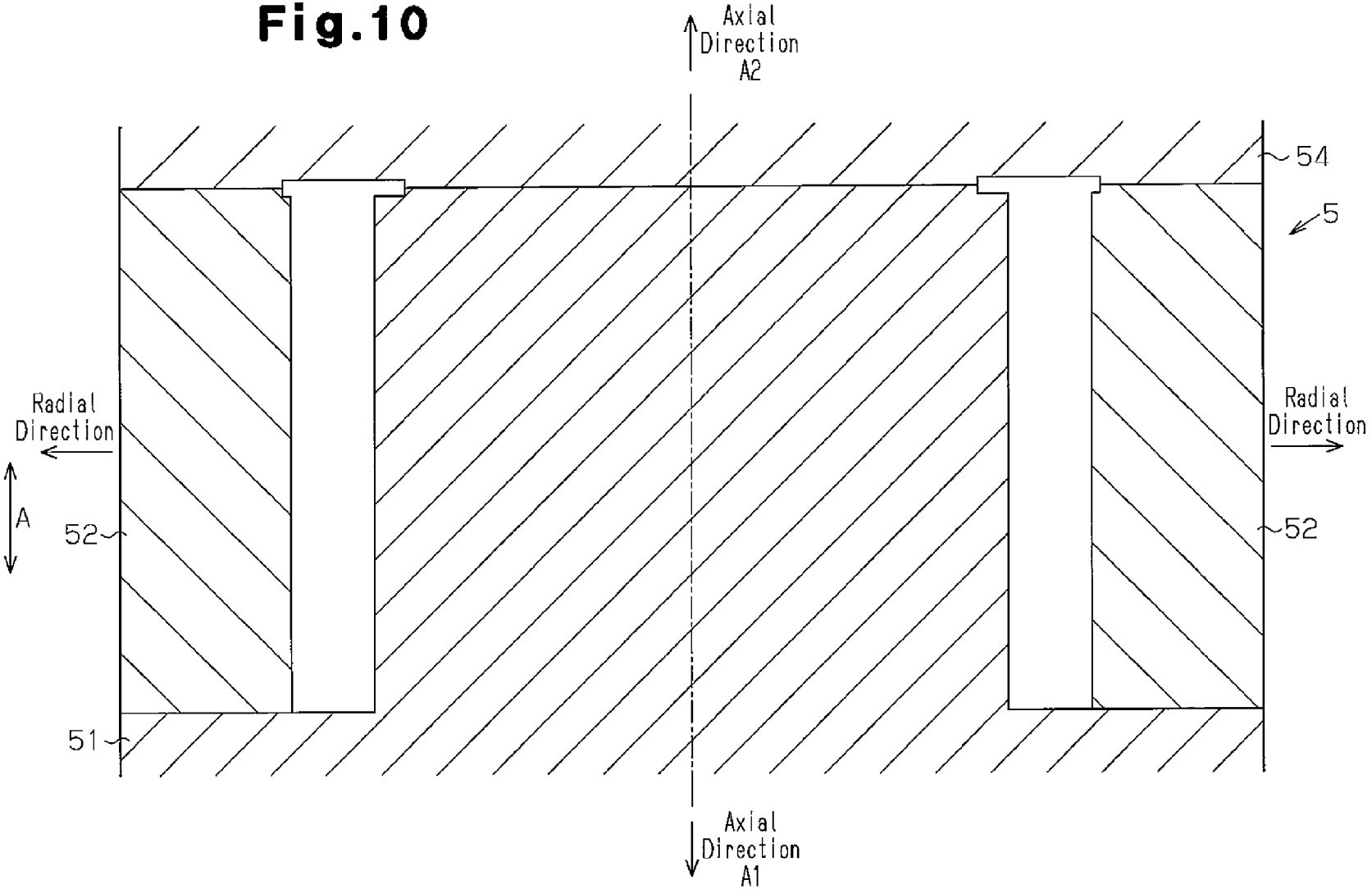
FIG. 10 is a cross-sectional view schematically showing the mold for molding the blade of the illustrated embodiment.

FIG. 10 is a cross-sectional view schematically showing the mold 5, as viewed along the longitudinal direction (the axial direction A) of each blade 42. The line formed by a long dash alternating with one short dash in the drawing represents the rotation axis of the impeller 41. After the blades 42 are formed, the mold portions 52 are removed. The mold portions 52 and the mold portion 54, which covers the corresponding ends of the blades 42, are also moved in the axial directions A1 or A2 and removed. Specifically, the mold portion 51, which is encompassed by the mold portions 52 and covers one end of each blade 42, is moved in the axial direction Al and removed. The mold portion 54, which covers the other end of the blade 42, is moved in the axial direction A2 and removed. By removing the mold portions 51, 52, 54 in the above-described manner, the blades 42 and the impeller 41, which includes the blades 42, are shaped. In other words, through injection molding, the blades 42 and the support plates 4*a*, which support the corresponding ends of the blades 42, are formed. That is, the support plates 4*a* each serving as a support member and the blades 42 are formed as an integral body, thus simplifying the steps for manufacturing the impeller 41.

Figure 11:
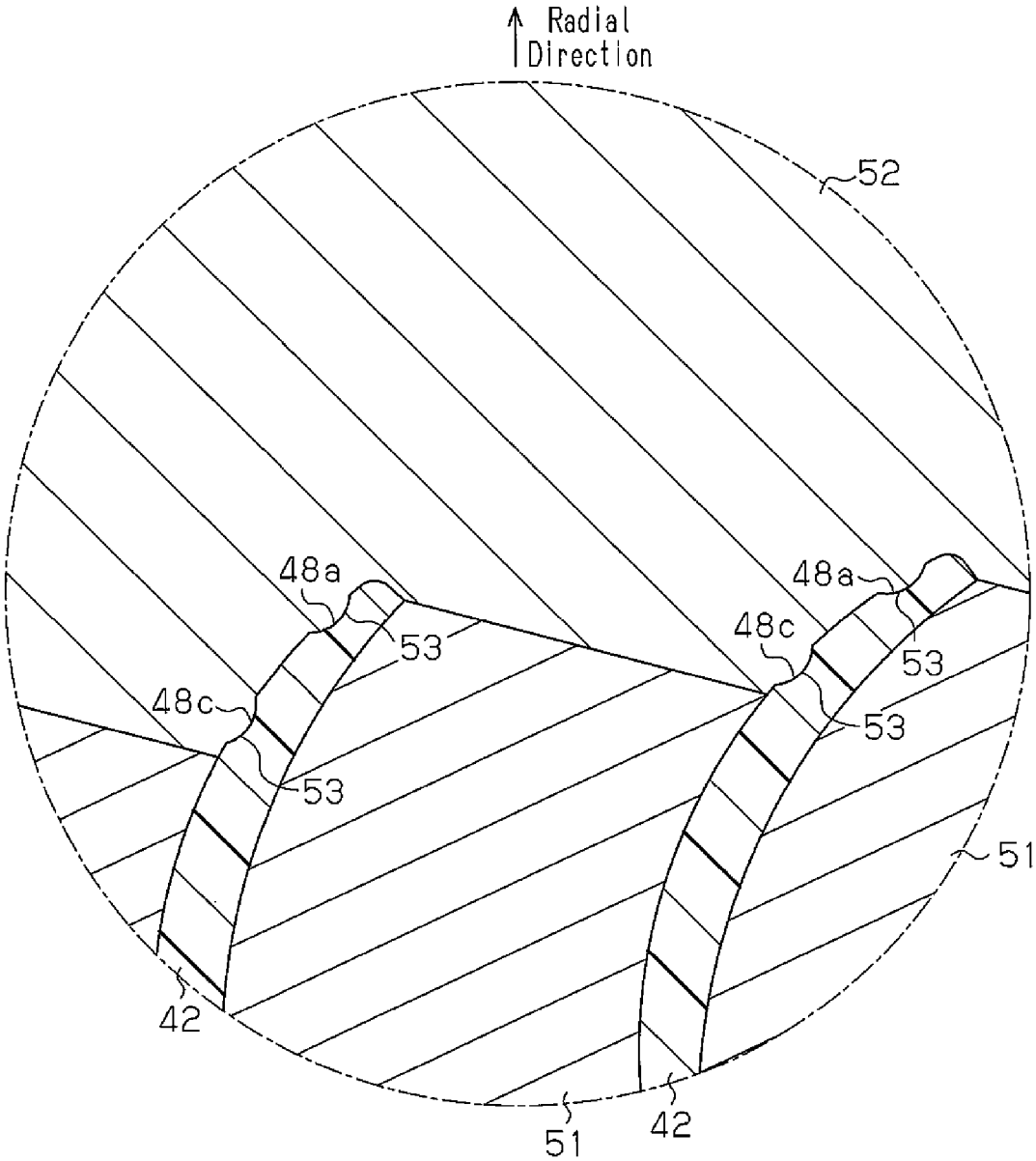
FIG. 11 is a cross-sectional view showing the mold for molding the blade of the illustrated embodiment and a molded blade.

The depths of the dimples 48*a*, 48*c* become smaller from the outer peripheral edge 43 toward the inner peripheral edge 44 in each blade 42. In other words, each of the dimples 48*c* has a small depth compared to each of the dimples 48*a*, 48*b*, which are arranged closer to the outer peripheral edge 43 than the dimples 48*c*. Accordingly, using the mold 5, the dimples 48 (the dimples 48*a*, 48*b*, 48*c*) are formed easily along the flow-in direction X. Specifically, when each mold portion 52 is removed after the corresponding blades 42 are formed using the mold portion 52, the projections 53 that project from the mold portion 52 to form the dimples 48 may interfere with the blades 42 each having a curved shape. This makes it difficult to move the mold portions 52 in the radial directions without damaging the blades 42, thus complicating removal of the mold 5 from the blades 42. To solve this problem, in the first embodiment, the depth of each of the dimples 48*c*, which are arranged at the rotation axis side of the impeller 41, is smaller than the depth of each of the dimples 48*a*, 48*b*, which are located at the centrifugal side of the impeller 41. This prevents the projections 53 in each mold portion 52 that shape the dimples 48*c* most spaced from the outer peripheral edge 43 from interfering with the blades 42 when the mold 5 is separated from the blades 42 by moving the mold portions 52 in the radial directions. That is, even if the blades 42 are formed by injecting the resin into the space between the mold portion 51 and the mold portions 52, as illustrated in FIG. 11, the mold portions 52 are moved radially without damaging the blades 42. FIG. 11 is an enlarged view showing the portion S2 represented by the chain line formed by a long dash alternating with one short dash in FIG. 9.

Figure 12:
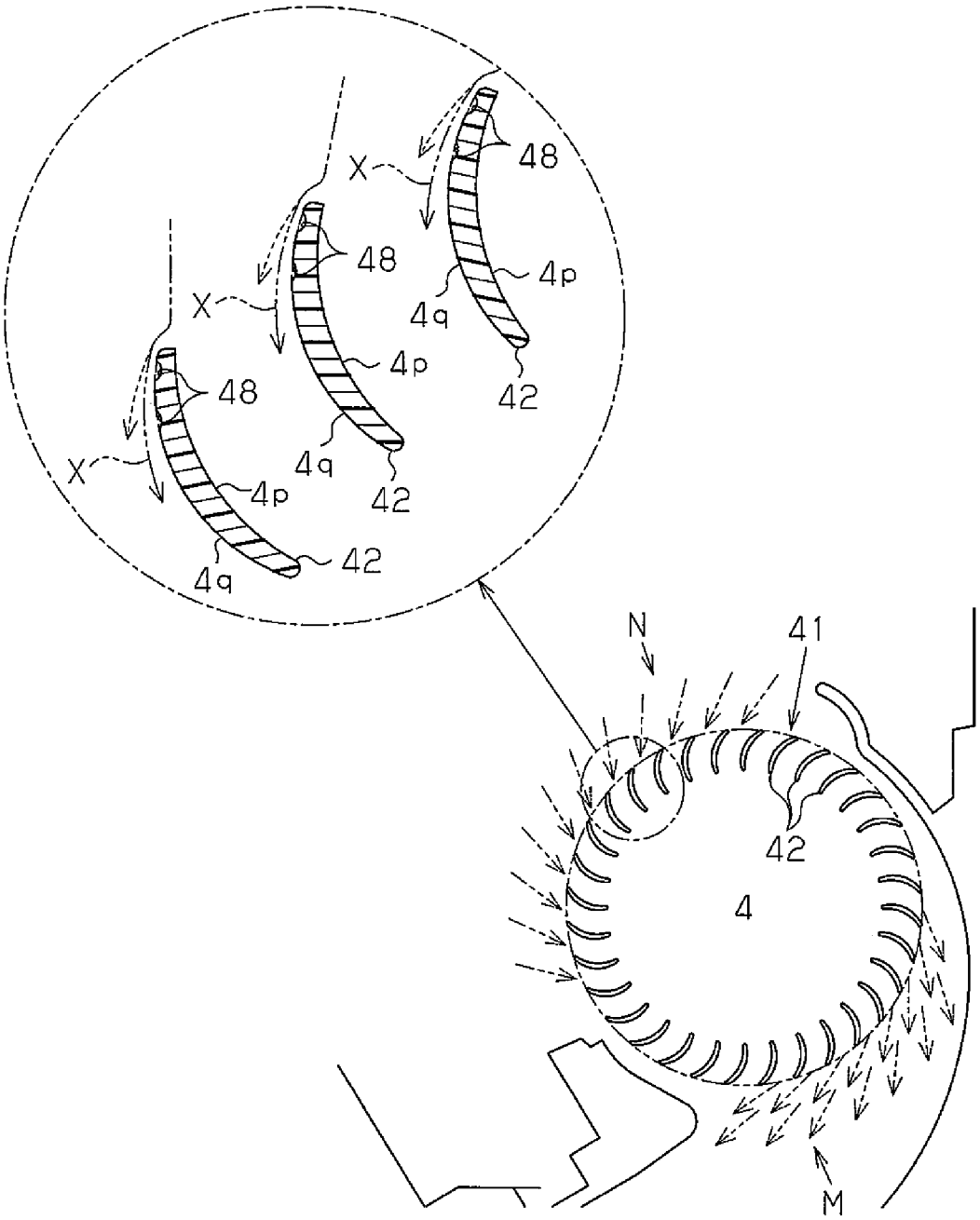
FIG. 12 is a cross-sectional view for illustrating the operation of dimples of the illustrated embodiment.

As has been described, the dimples 48 for preventing the air (the gas) flowing around each blade 42 from separating from the negative pressure surface 4*q* of the blade 42 at the side corresponding to the outer peripheral edge 43. As a result, the boundary layer at the negative pressure surface 4*q* of each blade 42 is changed from a laminar flow to a turbulent flow and a secondary airstream (represented by each arrow X2 in FIG. 13) is generated in each dimple 48. This decreases the shearing force produced at the bottom of the boundary layer and thus suppresses development of the boundary layer. As a result, with reference to FIG. 12, airstreams X proceed along the negative pressure surfaces 4*q* in an air inlet portion N in the crossflow fan 4. This configuration thus prevents separation of the air represented by the chain lines in FIG. 12.

Figure 13:
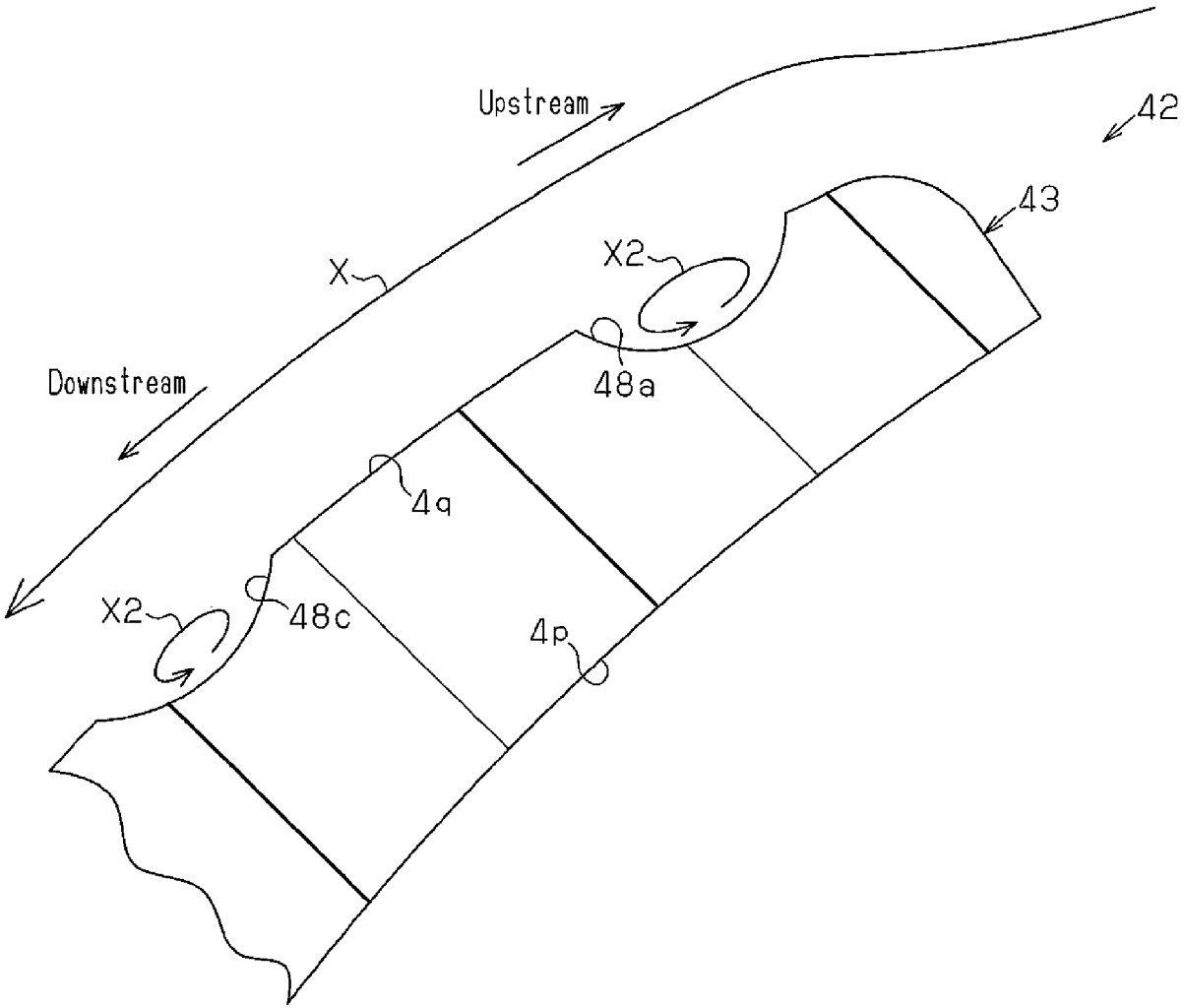
FIG. 13 is a cross-sectional view showing a blade of the illustrated embodiment in which a secondary gas stream for dimples is illustrated.

The depth of each dimple 48*c* formed in the negative pressure surface 4*q* of each blade 42 is smaller than the depth of each dimple 48*a*, 48*b*. As a result, compared to a case having dimples 348 with equal depths, a secondary airstream is suppressed as illustrated in FIGS. 13 and 14.

Figure 14:
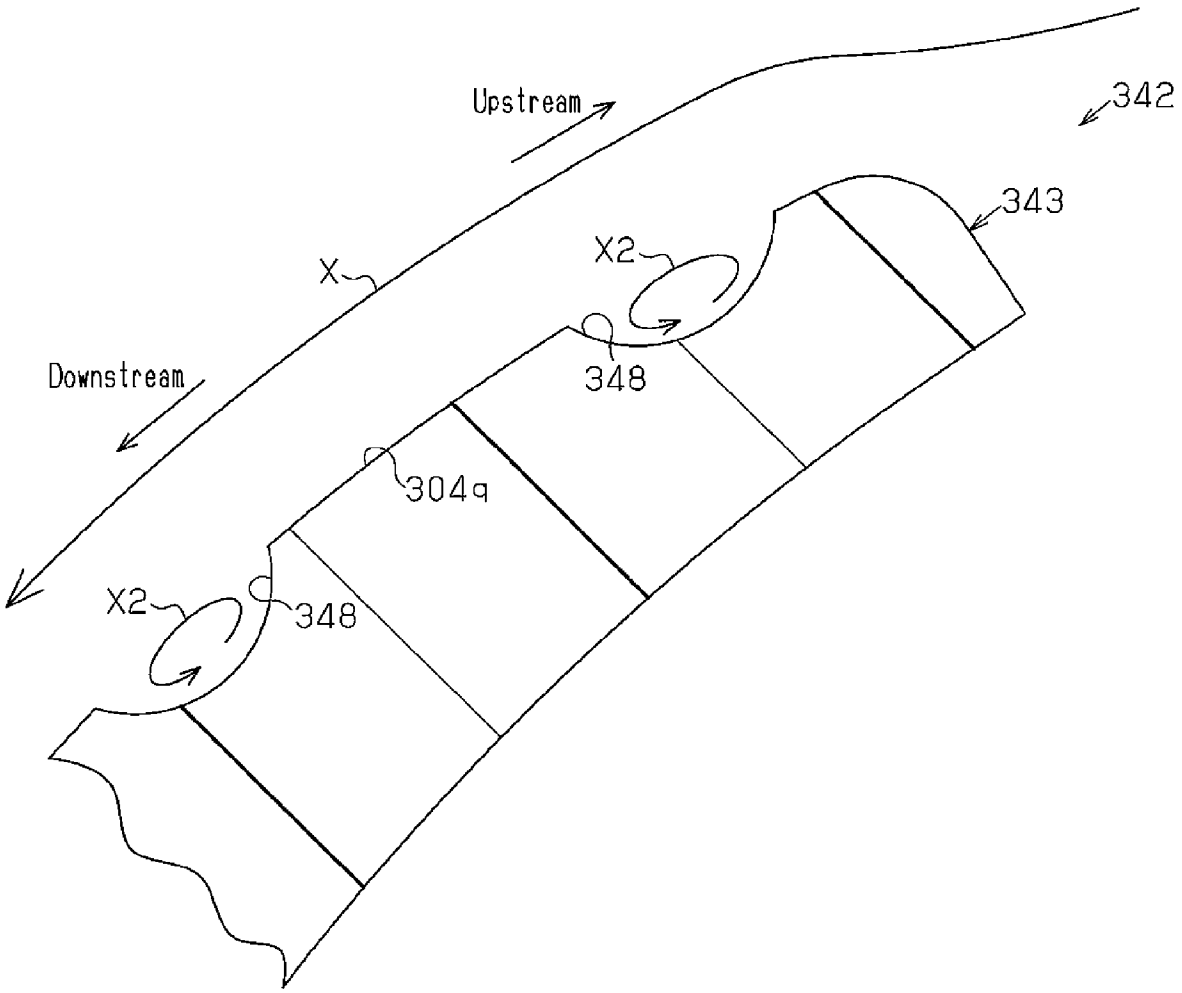
FIG. 14 is a cross-sectional view showing a blade of a reference example in which a secondary gas stream in dimples is illustrated.

As shown in FIG. 14, a plurality of dimples 348, which have identical shapes, are formed in a negative pressure surface 304 of a blade 342 in the vicinity of an outer peripheral edge 343 along the direction in which the air flows to the blade 342 (see arrow X in the drawing). In other words, in each blade 342 illustrated in FIGS. 13 and 14, the dimples 348 have equal diameters and equal depths. Secondary airstreams are represented by arrows X2.

As illustrated in FIG. 14, a secondary airstream is generated in each of the dimples 348, which are arranged at the upstream side and the downstream side. Loss caused by the secondary airstreams may hamper effective reduction of the drive power for the crossflow fan. In contrast, with reference to FIG. 13, each blade 42 of the first embodiment reduces the secondary airstream in the dimple 48*c* at the downstream side. Compared to the dimples 48*a*, 48*b* arranged upstream from the dimples 48*c*, the dimples 48*c* decrease the suppression effect of development of the boundary layer. This maintains the effect of the dimples 48 for preventing separation of the gas. As a result, the drive power for the crossflow fan 4 is effectively reduced.

Figure 15:
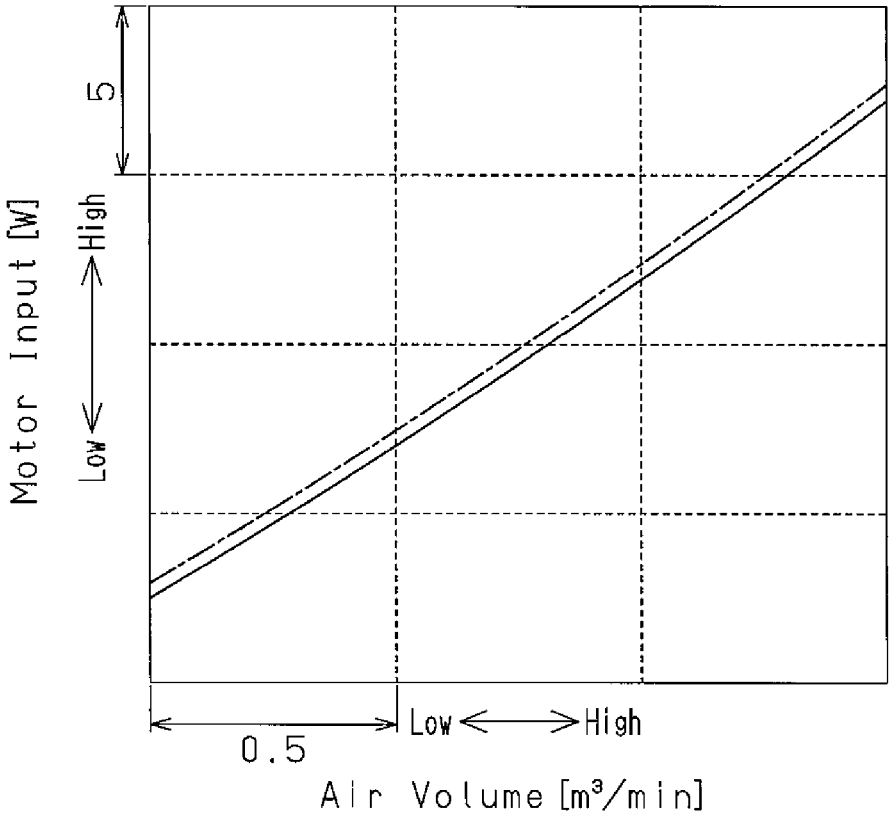
FIG. 15 is a graph representing the effect of the crossflow fan of the first embodiment of the invention.

Referring to FIG. 15, the blades 42 of the first embodiment reduce the input of the electric motor for driving the crossflow fan 4, compared to the input of a conventional electric motor. FIG. 15 is a graph representing the air volume-motor input characteristics of the crossflow fan 4 having the impeller 41 configured by the blades 42 and the air volume-motor input characteristics of the crossflow fan having the impeller 241 configured by the conventional blades 242. In FIG. 15, the solid line represents the air volume-motor input characteristics of the crossflow fan 4 according to the present invention. In the graph, the line formed by a long dash alternating with one short dash represents the air volume-motor input characteristics of the conventional crossflow fan. The axis of abscissas of the graph represents the air volume. Each unit grid of the axis of abscissas is 0.5 $m^3$/min. The axis of ordinate of the graph represents the motor input. Each unit grid of the axis of ordinate is 5 W.

The turbulent boundary layer controlling structure is configured by the dimples 48. Accordingly, separation of the gas flowing around the blades 42 is prevented from separating with improved effectiveness, compared to a case in which the turbulent boundary layer controlling structure is configured by a groove extending in the flow direction of the gas. In other words, if the dimples 48 are employed as the turbulent boundary layer controlling structure, the boundary layer is changed from a laminar flow to a turbulent flow. Also, a secondary stream is generated in each dimple 48 to reduce the shearing force produced at the bottom of the boundary layer. As a result, the gas flowing around the blades 42 is prevented further effectively from separating from the blades 42.

Particularly, according to the present invention, the multiple cutouts 45 are formed in each outer peripheral edge 43 and spaced apart at the predetermined intervals. This makes it easy for the air flowing around the impeller 41 (which is the blades 42) to flow into the cutouts 45, thus breaking the two dimensionality of the stream of the air flowing around the blades 42. However, in the invention, the dimples 48 each having a cross section modified along the axial direction and a direction perpendicular to the axial direction effectively prevent the air in the stream with the broken two dimensionality (which is, a stream with three dimensionality) from separating from the blades 42.

In other words, if the dimples 48 are formed in each blade 42 having the cutouts 45, the air flowing around the blade 42 is prevented from separating from the blade 42 effectively, compared to a case in which the dimples 48 are formed in a blade that does not have a cutout 45. As a result, with reference to FIGS. 16 and 17, the motor input is further reduced and the drive power for the crossflow fan 4 is reduced effectively, compared to the case in which the dimples are formed in the blade 42 that does not have a cutout 45.

Figure 16:
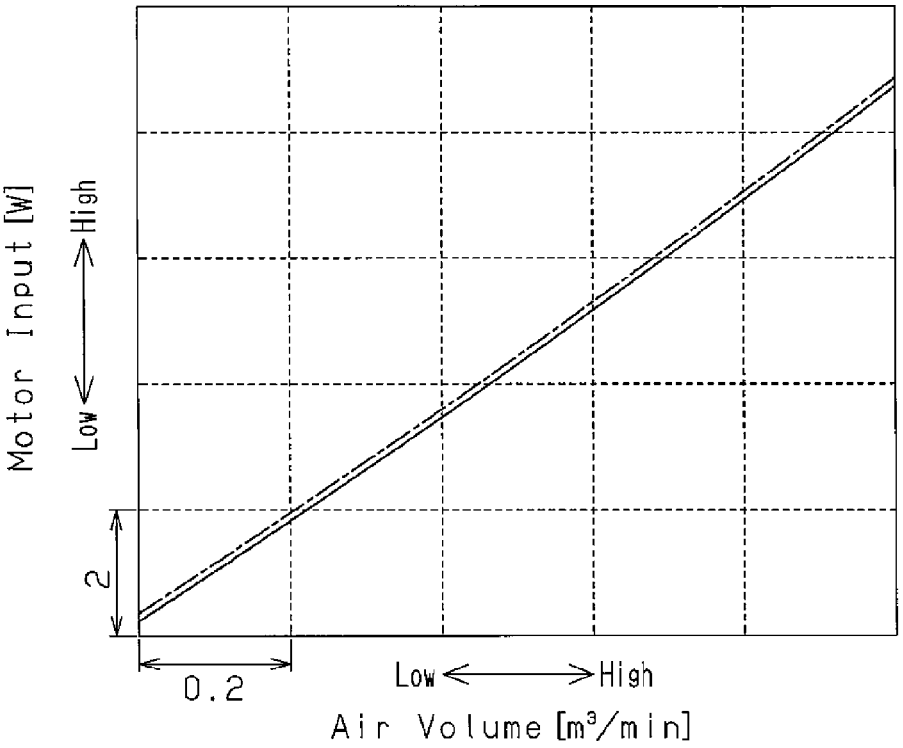
FIG. 16 is a graph representing the effect of dimples formed in a blade without a cutout.
Figure 17:
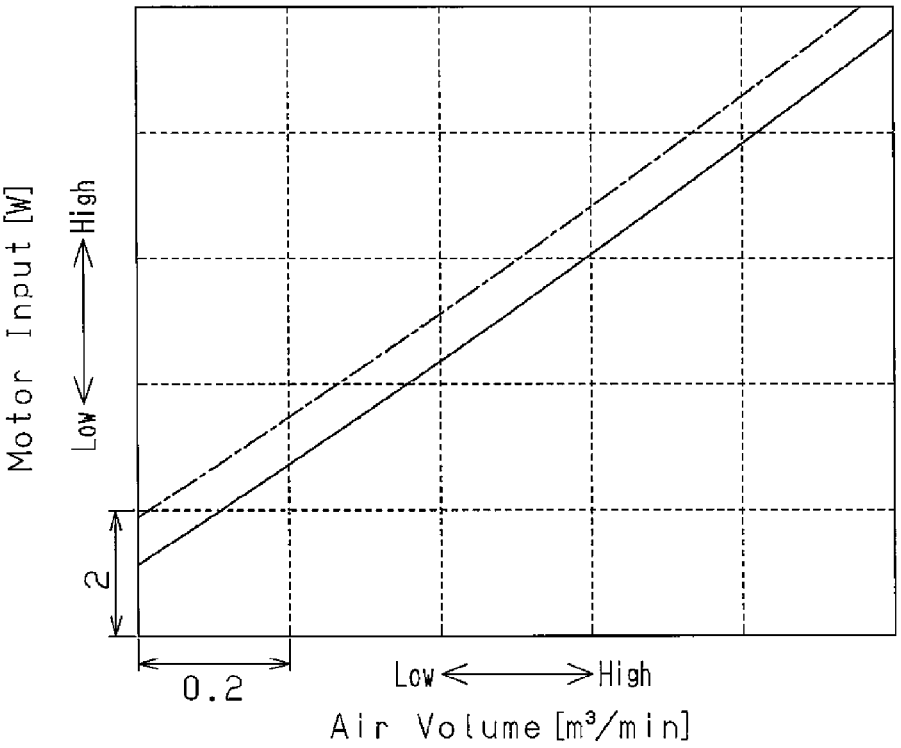
FIG. 17 is a graph representing the effect of dimples formed in a blade having cutouts.
Figure 18:
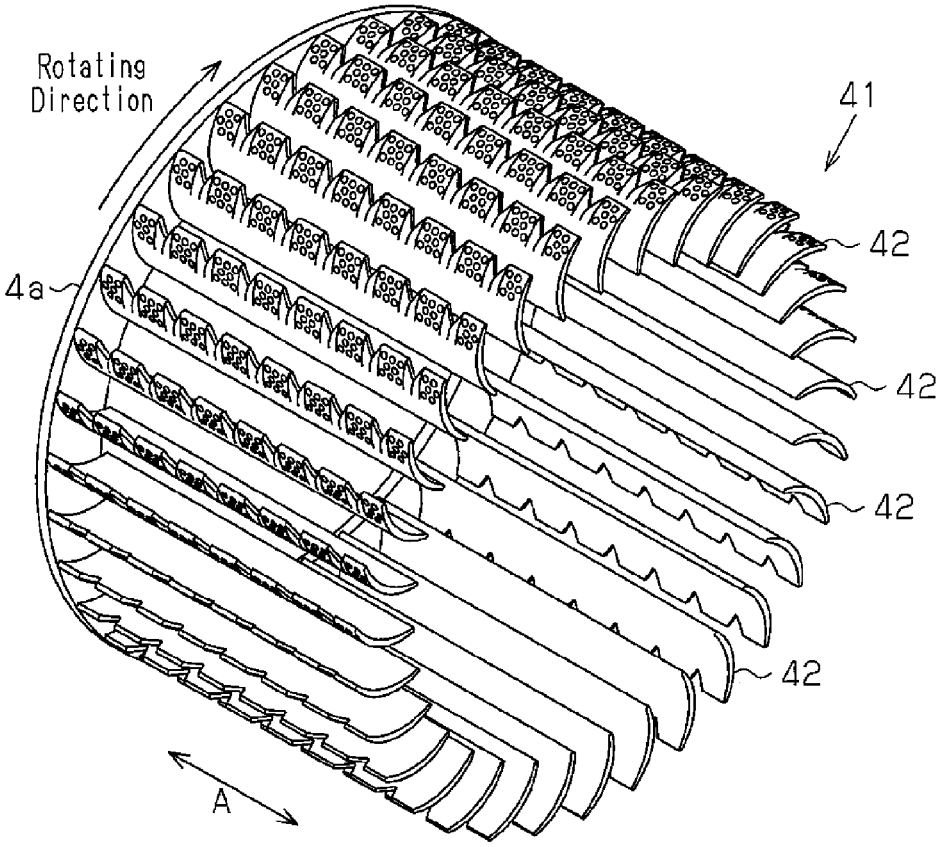
FIG. 18 is a perspective view showing an impeller according to a second embodiment of the invention.
Figure 19:
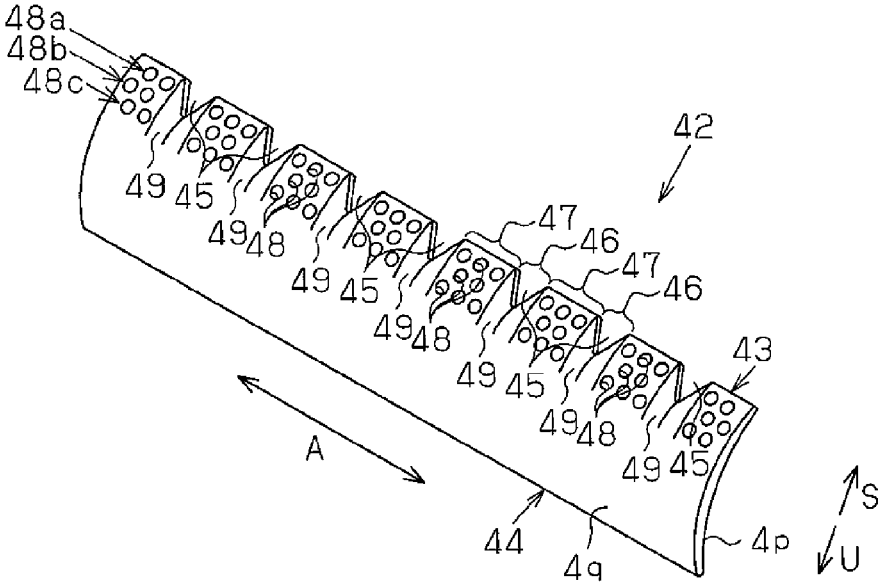
FIG. 19 is a perspective view showing a blade (a flap) of the second embodiment.
Figure 20:
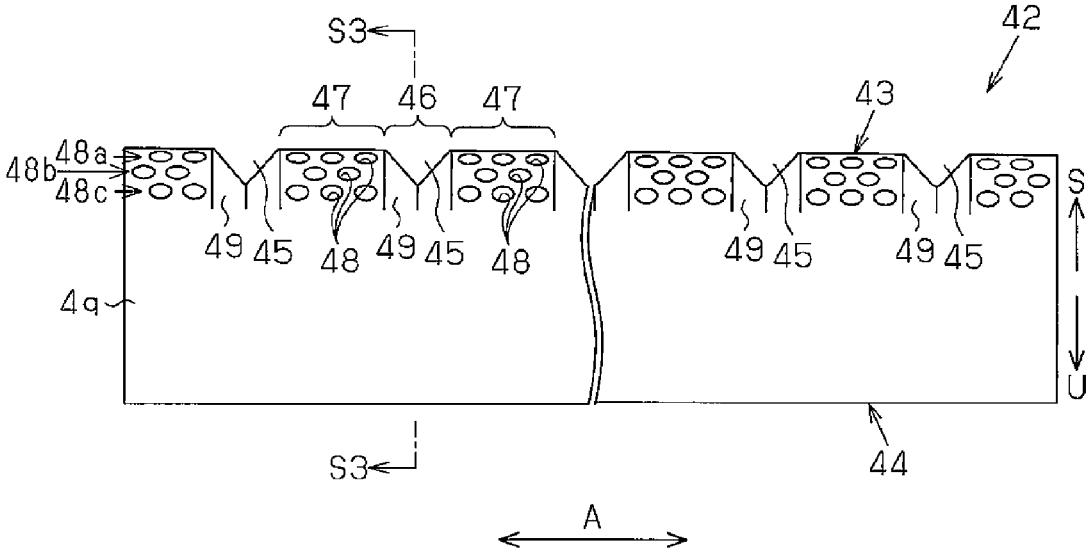
FIG. 20 is a view showing a negative pressure surface of the blade of the second embodiment.

FIG. 16 is a graph representing the air volume-motor input characteristics of a crossflow fan having an impeller configured by blades without a cutout 45. In FIG. 16, the line formed by a long dash alternating with one short dash represents the air volume-motor input characteristics of a crossflow fan having blades without a dimple 48. In the graph, the solid line represents the air volume-motor input characteristics of a crossflow fan having blades with dimples 48. FIG. 17 is a graph representing the air volume-motor input characteristics of a crossflow fan having an impeller configured by blades that have cutouts 45. In FIG. 17, the line formed by a long dash alternating with one short dash represents the air volume-motor input characteristics of a crossflow fan having blades without a dimple 48. In the graph, the solid line represents the air volume-motor input characteristics of a crossflow fan having blades with dimples 48. The axis of abscissas of each of the graphs in FIGS. 16 and 17 represents the air volume. Each unit grid of the axis of abscissas is 0.2 $m^3$/min. The axis of ordinate of each graph represents the motor input. Each unit grid of the axis of ordinate is 2 W.

The first embodiment has the advantages described below.

(1) The multiple cutouts 45 are formed in the outer peripheral edge 43 of each blade 42 and spaced apart at the predetermined intervals. The dimples 48 serving as the turbulent boundary layer controlling structure, which changes the boundary layer from a laminar flow to a turbulent flow, are formed in the negative pressure surface 4*q* of each blade 42 at the side corresponding to the outer peripheral edge 43 in order to prevent the gas flowing around the blade 42 from separating from the blade 42. In this configuration, the cutouts 45 in the outer peripheral edge 43, which are spaced apart at the predetermined intervals, reduce noise through a simple configuration. Also, the negative pressure surface 4*q* of each blade 42 has the dimples 48 for preventing the gas flowing around the blade 42 from separating from the blade 42 at the side corresponding to the outer peripheral edge 43. The dimples 48 change the boundary layer on the negative pressure surface 4*q* of the blade 42 from a laminar flow to a turbulent flow, thus preventing the air flowing around the blade 42 from separating from the blade 42. Particularly, in the present invention, the cutouts 45, which are formed in the outer peripheral edge 43 and spaced apart at the predetermined intervals, effectively prevent the air flowing around each blade 42 from separating from the blade 42. This reduces the resistance to the pressure acting on the blade 42, thus reducing the drive power for the crossflow fan 4 effectively compared to a case without a dimple 48.

(2) The turbulent boundary layer controlling structure for changing the boundary layer from a laminar flow to a turbulent flow is the dimples 48. This prevents the gas flowing around each blade 42 from separating from the blade 42 with improved effectiveness, compared to a case in which the turbulent boundary layer controlling structure are grooves extending in the gas flow direction. That is, by changing the boundary layer from a laminar flow to a turbulent flow and generating a secondary stream in each dimple 48, the shearing force produced at the bottom of the boundary layer is decreased. As a result, the air flowing around each blade 42 is prevented from separating from the blade 42 with increased effectiveness.

(3) The depths of the dimples 48 become smaller from the outer peripheral edge 43, in which the dimples 48 are formed, toward the inner peripheral edge 44. In other words, the depth of each of the dimples 48*c*, which are most spaced from the outer peripheral edge 43 of each blade 42, is smaller than the depth of each of the dimples 48*a*, which are closer to the outer peripheral edge 43 than the dimples 48*c*. By varying the depths of the dimples 48 in this manner, the effect for suppressing development of a boundary layer is decreased. Also, loss caused by a secondary airstream in each dimple 48*c*, which is spaced from the outer peripheral edge 43, is reduced. Further, compared to the dimples 48*a* closer to the outer peripheral edge 43, the dimples 48*c* have a small effect in suppressing development of the boundary layer. This maintains the effect of the dimples 48 for preventing separation of the air. As a result, compared to a case with dimples 48 having equal depths, the drive power for the crossflow fan 4 is saved.

(4) Among the dimples 48, the dimples 48*c* arranged at the rotation axis side have a small depth compared to the dimples 48*a* located at the centrifugal side. In this configuration, when the mold 5 is removed from the blades 42, the projections 53 that are projected from each mold portion 52 to shape the dimples 48*c*, which are at the rotation axis side, are prevented from interfering with the blades 42. As a result, the mold 5 for shaping the blades 42 is easily separated. The dimples 48 are thus easily formed in the negative pressure surface 4*q* of each blade 42 along the direction in which the air flows.

The air conditioner 1 has the crossflow fan 4, which has the advantages (1) to (4). Accordingly, the air conditioner 1 according to the first embodiment has the same advantages as the advantages (1) to (4). The blades 42, which are arranged along the rotating direction, and the support plates 4*a* serving as the support members that support the corresponding ends of the blades 42 are formed as an integral body. As a result, the method for manufacturing the blades 42 according to the first embodiment simplifies the steps for manufacturing the impeller 41.

(Second Embodiment)

A second embodiment of the present invention will hereafter be described. The configuration of an air conditioner as a whole and the configuration of a crossflow fan according to the second embodiment are the same as the corresponding configurations of the first embodiment. Detailed description thereof thus will be omitted.

Figure 21:
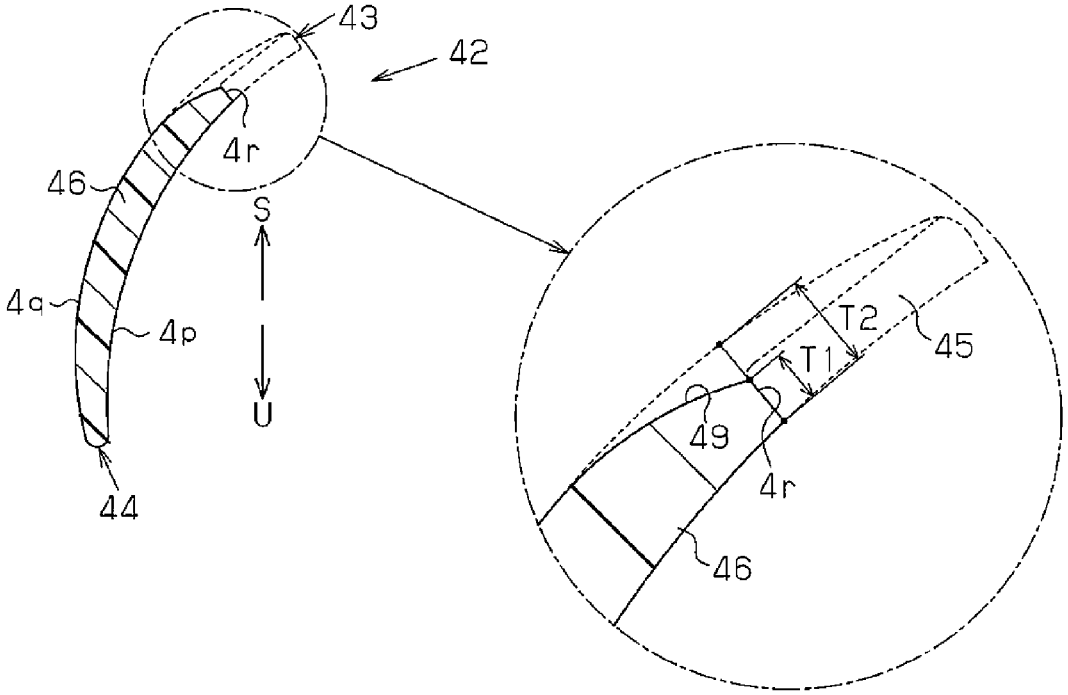
FIG. 21 is a cross-sectional view taken along line S3-S3 of FIG. 20.

In the second embodiment, as shown in FIGS. 18 to 21, the blades 42 are characterized in that the thickness T1 of each of the cut portions 46 is smaller than the thickness T2 of each of the basic shape portions 47, which are adjacent to the cut portions 46. The dimples 48 are formed not in the cut portions 46 but only in the basic shape portions 47. Recesses 49 are formed in the negative pressure surface 4*q* at the positions corresponding to the cut portions 46. As a result, as illustrated in FIG. 21, the thickness T1 of each cut portion 46 is smaller than the thickness T2 of each basic shape portion 47, which is adjacent to the corresponding cut portion 46. This configuration increases the pressure applied to an airstream compared to a case in which recesses are formed in the positive pressure surface 4p.

Figure 22:
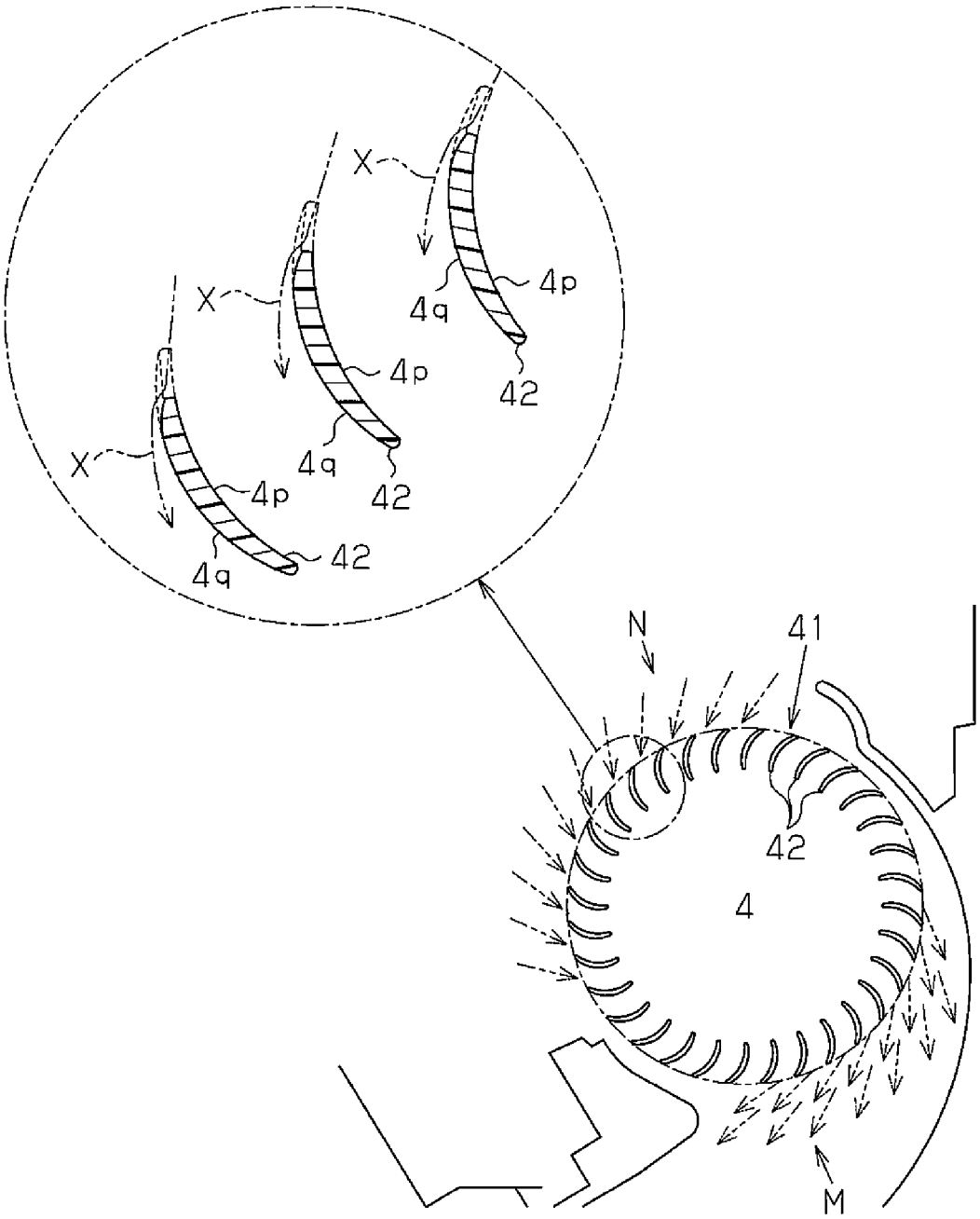
FIG. 22 is a cross-sectional view illustrating an airstream in the blade of the second embodiment.
Figure 23:
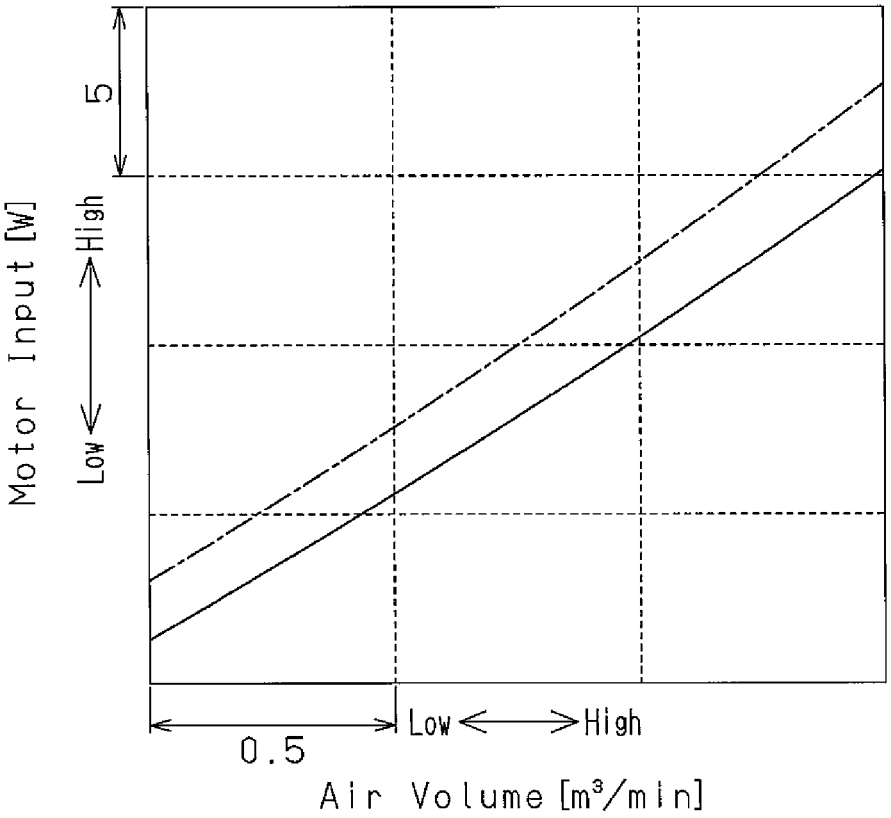
FIG. 23 is a graph representing the effect of the crossflow fan according to the second embodiment of the invention.
Figure 24:
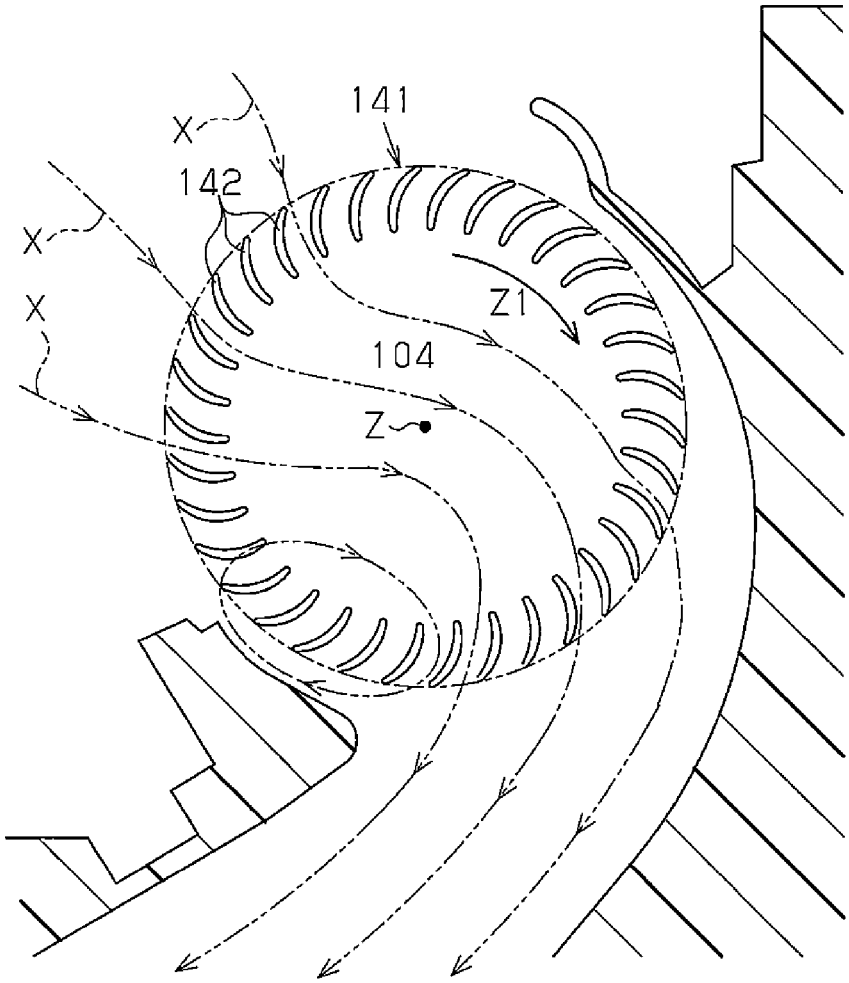
FIG. 24 is a view illustrating a crossflow fan.
Figure 25:
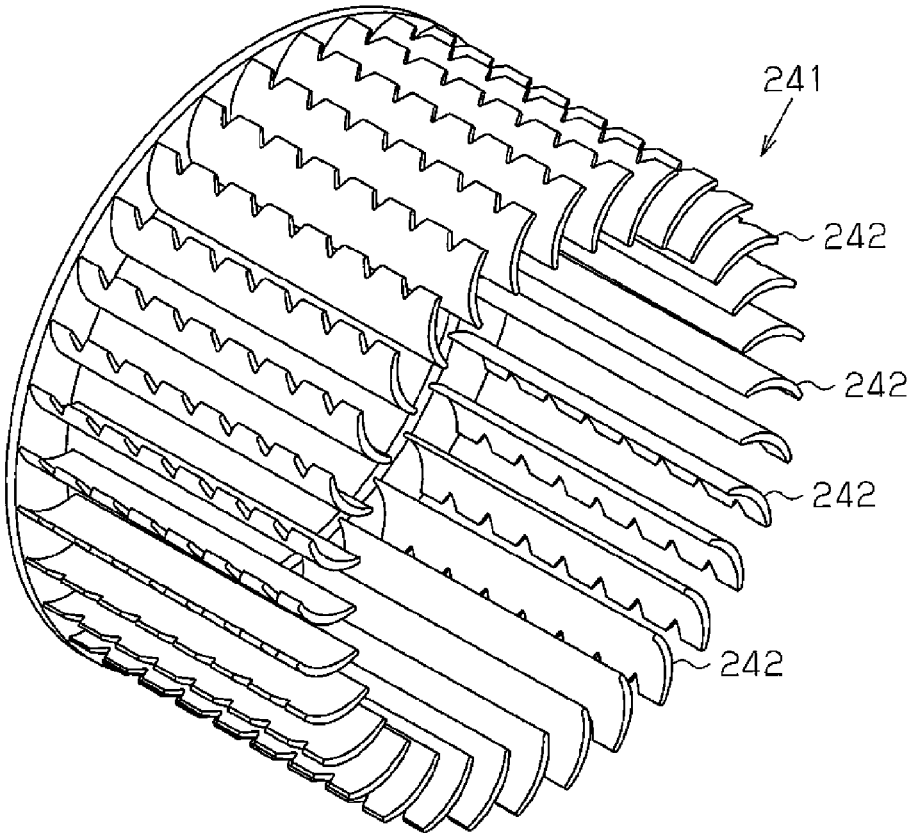
FIG. 25 is a perspective view showing an impeller in a conventional crossflow fan.
Figure 26:
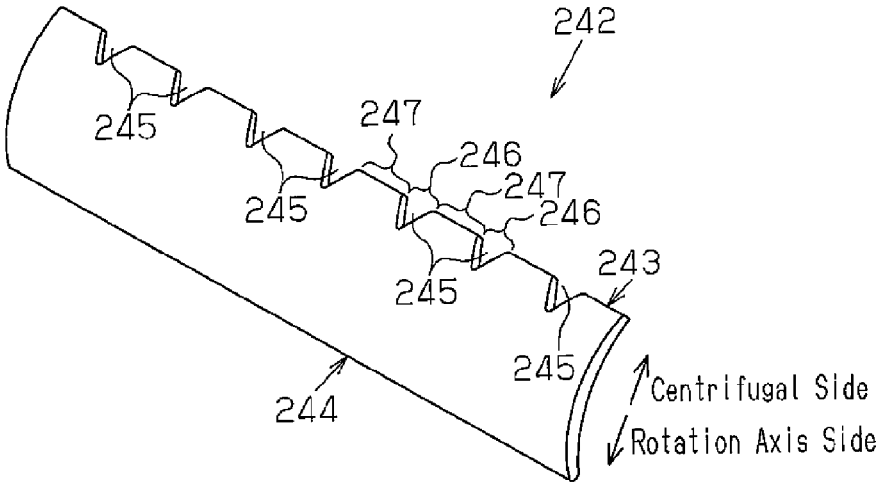
FIG. 26 is a perspective view showing a conventional blade (flap).

In this configuration, an end surface 4*r* of the outer peripheral edge 43 of each blade 42 has a small surface area. This reduces the collision loss of an airstream X striking against each cut portion 46 in the air inlet portion N of the crossflow fan 4, as shown in FIG. 22. As a result, with reference to FIG. 23, the input of an electric motor for driving the crossflow fan 4 is decreased compared to the input of a conventional electric motor. FIG. 23 is a graph representing the air volume-motor input characteristics of the crossflow fan 4 having the impeller 41 configured by the blades 42 of the second embodiment and the air volume-motor input characteristics of the crossflow fan having the impeller 241 configured by the conventional blades 242. In FIG. 23, the solid line represents the air volume-motor input characteristics of the crossflow fan 4 according to the present invention. In the graph, the line formed by a long dash alternating with one short dash represents the air volume-motor input characteristics of the conventional crossflow fan.

As illustrated in FIG. 21, the thickness T1 of each cut portion 46 becomes smaller toward the associated cutout 45 (the outer peripheral edge 43) along a direction parallel to the blade chord. In other words, the thickness T1 becomes smaller in an upstream direction of the air flowing on the negative pressure surface 4*q* of each blade 42. Accordingly, a cross section of the blade 42 perpendicular to the axial direction A may be shaped as a smoothly curved surface. Also, the thickness Ti of each cut portion 46 becomes smaller toward the center of the associated cutout 45 in the axial direction A. As a result, no step is formed between each cut portion 46 and the adjacent basic shape portion 47.

The crossflow fan 4 of the second embodiment has the advantages described below, in addition to the advantages (1) to (4).

(5) The thickness T1 of each cut portion 46 is smaller than the thickness T2 of each basic shape portion 47, which is adjacent to the corresponding cut portion 46. This reduces the surface area of the end surface 4*r* of the outer peripheral edge 43, compared to a case in which the thickness T1 of each cut portion 46 is equal to the thickness T2 of each basic shape portion 47. As a result, the collision loss generated when air flows into the impeller 41 is decreased. The drive power for the crossflow fan 4 is thus further effectively reduced.

(6) The dimples 48 are formed in the basic shape portion 47. Accordingly, if the blades 42 are formed in such a manner that the thickness T1 of each cut portion 46 becomes smaller than the thickness T2 of each basic shape portion 47, which is adjacent to the corresponding cut portion 46, dimples 48 each having a desirable depth are formed easily. In other words, the depth of each dimple 48 is easily ensured.

The air conditioner 1 has the crossflow fan 4 according to the second embodiment. As a result, the air conditioner 1 of the second embodiment has the same advantages as the advantages (5) and (6), in addition to the advantages (1) to (4).

The present invention is not restrictive to the illustrated embodiments but may be modified at various points based on the gist of the invention. The modifications are not to be excluded from the scope of the invention. For example, the illustrated embodiments may be modified to the forms described below.

In the illustrated embodiments, the depth of each dimple 48*b* may be smaller than the depth of each dimple 48*a* and greater than the depth of each dimple 48*c*. In other words, the dimples 48 the depths of which become smaller from the outer peripheral edge 43 toward the inner peripheral edge 44 may be all the dimples 48*a*, 48*b*, 48*c*, which configure the dimples 48.

In the illustrated embodiments, the dimples 48 are formed in the negative pressure surface 4*q* of each blade 42 as the turbulent flow boundary surface controlling structure. However, the turbulent flow boundary controlling structure may be configured by groove(s) or rough surfaces (neither is shown).

In the illustrated embodiments, the cutouts 45 are formed in the outer peripheral edge 43 of each blade 42. However, cutouts like the cutouts 45 may be formed in the inner peripheral edge 44 of each blade 42. In other words, cutouts may be formed in either or both of the outer peripheral edge 43 and the inner peripheral edge 44. If cutouts are formed in both the outer peripheral edge 43 and the inner peripheral edge 44, noise is reduced with improved effectiveness. If cutouts are formed in the inner peripheral edge 44, the blade thickness may be varied as in the case of the second embodiment.

In the illustrated embodiments, cutouts may be formed in the inner peripheral edge 44 of each blade 42 and a turbulent flow boundary surface controlling structure may be formed in the negative pressure surface 4*q* of each blade 42 at the side corresponding to the inner peripheral edge 44. If a plurality of dimples are formed in the negative pressure surface 4*q* of each blade 42 at the side corresponding to the inner peripheral edge 44 along the flow direction of the air, it is preferable that the depths of the dimples that are close to the inner peripheral edge 44 become smaller from the inner peripheral edge 44 toward the outer peripheral edge 43. This configuration has advantages that are similar to the advantages of the illustrated embodiments.

The invention claimed is:

1. A crossflow fan, comprising:

a rotary impeller formed by curved blades, wherein each blade has an outer peripheral edge arranged at a centrifugal side of the impeller and an inner peripheral edge located at a rotation axis side of the impeller, a plurality of cutouts being formed in at least one of the outer peripheral edge and the inner peripheral edge and spaced apart at predetermined intervals, and a turbulent boundary layer controlling structure that prevents a gas flowing around the blade from separating from the blade by changing a boundary layer from a laminar flow to a turbulent flow is formed in a negative pressure surface of the blade at the peripheral edge in which the cutouts are formed, the turbulent boundary layer controlling structure is a dimple, the dimple is one of a plurality of dimples, the dimples being formed along a flow direction of the gas and in the negative pressure surface of the blade in the vicinity of the peripheral edge in which the cutouts are formed, and the dimples have depths that become smaller from the peripheral edge in which the dimples are formed toward the other peripheral edge, each blade has a cut portion that is cut in at least one of the outer peripheral edge and the inner peripheral edge, and a basic shape portion that is a non-cut portion, and the turbulent boundary layer controlling structure is formed in the basic shape portion.

2. The crossflow fan according to claim 1, wherein each blade has a cut portion that is cut in at least one of the outer peripheral edge and the inner peripheral edge and a basic shape portion that is a non-cut portion, and the blade thickness at the cut portion is smaller compared to the blade thickness at the basic shape portion adjacent to the cut portion.

3. An air conditioner having the crossflow fan according to claim 1.

* * * * *